US009383165B2

(12) United States Patent
Gregory et al.

(10) Patent No.: US 9,383,165 B2
(45) Date of Patent: Jul. 5, 2016

(54) LOCKABLE HOLSTER

(71) Applicant: Alliant Techsystems Inc., Minneapolis, MN (US)

(72) Inventors: Thomas M. Gregory, Boise, ID (US); Robert A. Kincaid, Bozeman, MT (US); Clifton L. Cook, Sheridan, WY (US); Eric M. Yeates, Virgina Beach, VA (US); Thomas A. Marx, Virginia Beach, VA (US)

(73) Assignee: Vista Outdoor Operations LLC, Clearfield, UT (US)

( * ) Notice: Subject to any disclaimer, the term of this patent is extended or adjusted under 35 U.S.C. 154(b) by 92 days.

(21) Appl. No.: 14/229,944

(22) Filed: Mar. 30, 2014

(65) Prior Publication Data

US 2014/0209645 A1 Jul. 31, 2014

Related U.S. Application Data

(63) Continuation of application No. 13/508,759, filed as application No. PCT/US2010/002935 on Nov. 9, 2010, now Pat. No. 8,720,755.

(60) Provisional application No. 61/335,856, filed on Jan. 13, 2010, provisional application No. 61/280,829, filed on Nov. 9, 2009.

(51) Int. Cl.
*F41C 33/00* (2006.01)
*F41C 33/02* (2006.01)

(52) U.S. Cl.
CPC ..... *F41C 33/0263* (2013.01); *F41C 33/0209* (2013.01)

(58) Field of Classification Search
CPC ..... A45F 2200/0591; F41C 33/0209; F41C 33/0218; F41C 33/0227; F41C 33/0263
USPC ..... 224/193, 242–244, 911, 912
See application file for complete search history.

(56) References Cited

U.S. PATENT DOCUMENTS

| | | | | | |
|---|---|---|---|---|---|
| 3,910,469 | A * | 10/1975 | Baldocchi | F41C 33/0245 | 224/198 |
| 7,841,497 | B1 * | 11/2010 | Gregory | F41C 33/0263 | 224/243 |
| 8,235,263 | B1 * | 8/2012 | Yeates | F41C 33/0227 | 224/193 |
| 8,474,670 | B1 * | 7/2013 | Gregory | F41C 33/0263 | 224/243 |
| 2011/0174849 | A1 * | 7/2011 | Clifton, Jr. | F41C 33/0209 | 224/243 |
| 2011/0266317 | A1 * | 11/2011 | Clifton | A45F 5/02 | 224/242 |

* cited by examiner

*Primary Examiner* — Adam Waggenspack
(74) *Attorney, Agent, or Firm* — Shaddock Law Group, PC

(57) ABSTRACT

A holster having a cavity and an axis defined along a side wall of the holster; a lever having a finger button portion and an engagement portion, wherein the lever is pivotally attached atop the side wall of the holster, along the axis, approximately between the finger button portion and the engagement portion, such that the finger button portion extends from the axis and is positioned above the frame/slide portion of the cavity and the engagement portion extends from the axis and is positioned above the trigger guard portion of the cavity; a hollow formed within a portion of the side wall; and a lockout lever rotatably secured within at least a portion of the hollow, and wherein a locking portion of the lockout lever is positioned beneath the finger button portion of the lever when the lockout lever is in a locked position.

20 Claims, 27 Drawing Sheets

LOCKABLE HOLSTER

CROSS-REFERENCE TO RELATED APPLICATIONS

This patent application claims the benefit of U.S. patent application Ser. No. 13/508,759, filed May 9, 2012, International Application Serial No. PCTUS2010002935, filed Nov. 9, 2010, U.S. Patent Application Ser. No. 61/335,856, filed Jan. 13, 2010, and U.S. Patent Application Ser. No. 61/280,829, filed Nov. 9, 2009, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE INVENTION

1. Field of the Invention

The presently disclosed invention relates generally to handgun holsters. In particular, the present invention relates to a handgun holster having a lockable retention system.

2. Description of Related Art

Many users of handguns, particularly military and law enforcement personnel, carry a handgun in a holster designed to protect the handgun and hold it securely. Holsters can be worn in a number of ways, such as on a belt at the waist, on the thigh, under an arm, or around an ankle.

Certain users of handguns must be able to quickly and easily remove the handgun from a holster regardless of the type of holster used. Additionally, these users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

SUMMARY OF THE INVENTION

The present invention relates generally to handgun holsters. In particular, the present invention relates to a holster for a weapon, such as, for example, a handgun, having a retention system for securing a handgun such that the handgun is retained or locked in the holster when the retention system is engaged, but may be easily removed from the holster by the wearer while removal by anyone other than the wearer is difficult.

In an illustrative, non-limiting embodiment of this invention, the handgun holster comprises a handgun holster having a retention system. The retention system comprises a lever having an engagement portion and a finger button portion, the engagement portion includes a locking projection for engaging an interior portion of the trigger guard of the handgun in the holster and, thereby, retaining the handgun in the holster.

The construction of the holster prevents the locking projection from contacting the trigger of the handgun by limiting how far the handgun can be inserted into the holster. The construction of the holster further facilitates alignment of the trigger guard with the locking projection by limiting movement of the handgun with respect to the lever.

The lever is positioned on the holster such that, when a user depresses the appropriate portion of the lever, thereby releasing the handgun from the holster, and draws the handgun from the holster, the user's index finger is positioned to contact the frame of the handgun, above the trigger guard.

In an illustrative, non-limiting embodiment of this invention, a biasing element is optionally included. If included, the biasing element contacts a front portion of the handgun's trigger guard and is spring-biased when the handgun is retained, or locked, in the holster. The biasing element biases the handgun out of the holster and assists in maintaining contact between the locking projection and the trigger guard. Furthermore, the biasing element may assist in removal of the handgun from the holster when the locking projection is disengaged from the trigger guard.

In one illustrative, non-limiting embodiment of this invention, the holster includes a cavity having an open top end, a bottom end, a frame/slide portion, and a trigger guard portion. The frame/slide portion of the cavity has greater depth than the trigger guard portion of the cavity. An axis extends between the frame/slide portion of the cavity and the trigger guard portion of the cavity.

A lever having a finger button portion and an engagement portion is pivotally attached atop the side wall of the holster, along the axis, approximately between the finger button portion and the engagement portion, such that the finger button portion extends from the axis and is positioned above the frame/slide portion of the cavity and the engagement portion extends from the axis and is positioned above the trigger guard portion of the cavity.

The lever includes a second side facing generally toward the holster cavity, and the engagement portion of the lever includes a locking projection extending from the second side of the engagement portion; wherein the lever.

In certain illustrative, non-limiting embodiment of this invention, the holster further includes at least one ridge segment extending from the side wall around at least a portion of the lever so as to define a recess. The lever is positioned within the recess and an aperture formed in a portion of the side wall beneath at least a portion of the finger button portion of the lever, wherein the aperture is formed within the recess.

Thus, the present invention automatically locks the handgun in place in the holster with a releasable mechanism that is easily operated by a wearer of the holster. However, the present mechanism is not easily accidentally disengaged or disengaged by anyone other than the wearer.

Accordingly, this invention provides a handgun holster, having a retention system.

The presently disclosed invention separately provides a safe and reliable quick-release handgun holster.

The presently disclosed invention separately provides a handgun holster having a retention system, which is capable of retaining a handgun securely in the holster while permitting a quick release of the handgun when the user requires.

The presently disclosed invention separately provides a handgun holster having a retention system, which is simple to operate.

The presently disclosed invention separately provides a handgun holster having a retention system, which automatically secures the handgun in the holster upon seating of the handgun in the holster, without requiring any additional operation by the user.

The presently disclosed invention separately provides a handgun holster and a retention system that assists the user in positioning his or her index finger along the frame of the handgun, outside of and not on the trigger guard, as the handgun is drawn from the holster.

The presently disclosed invention separately provides a handgun holster having an optional passive retention system, which can be tightened to provide increased frictional tension between a portion of the holster and the handgun trigger guard without increasing the frictional tension between a remaining portion of the holster and the handgun.

The presently disclosed invention separately provides a handgun holster, which is capable of being manufactured using injection molding production techniques.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
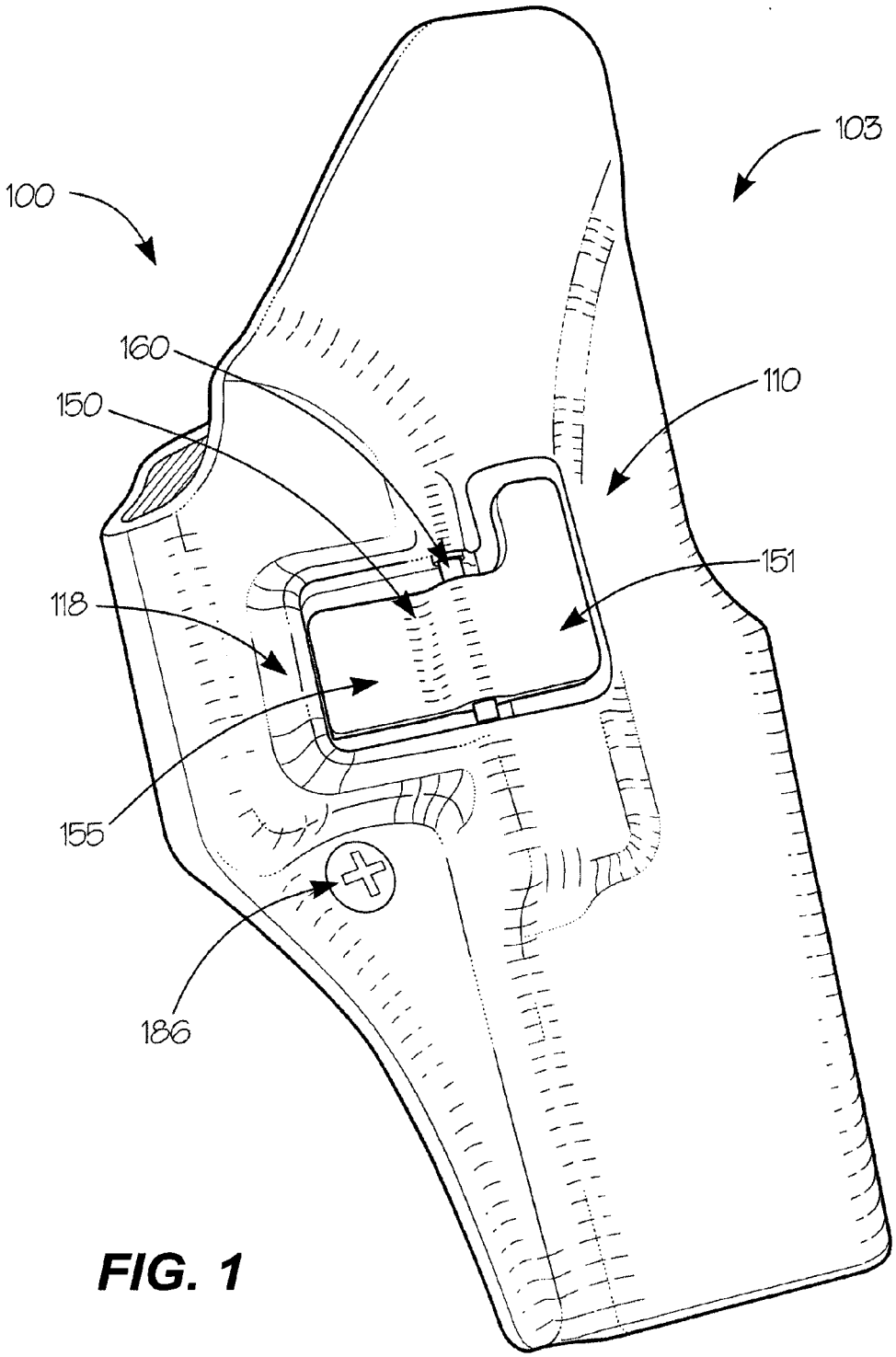
FIG. 1 shows a right perspective view of a first exemplary embodiment of a handgun holster having a retention system according to this invention.
Figure 2:
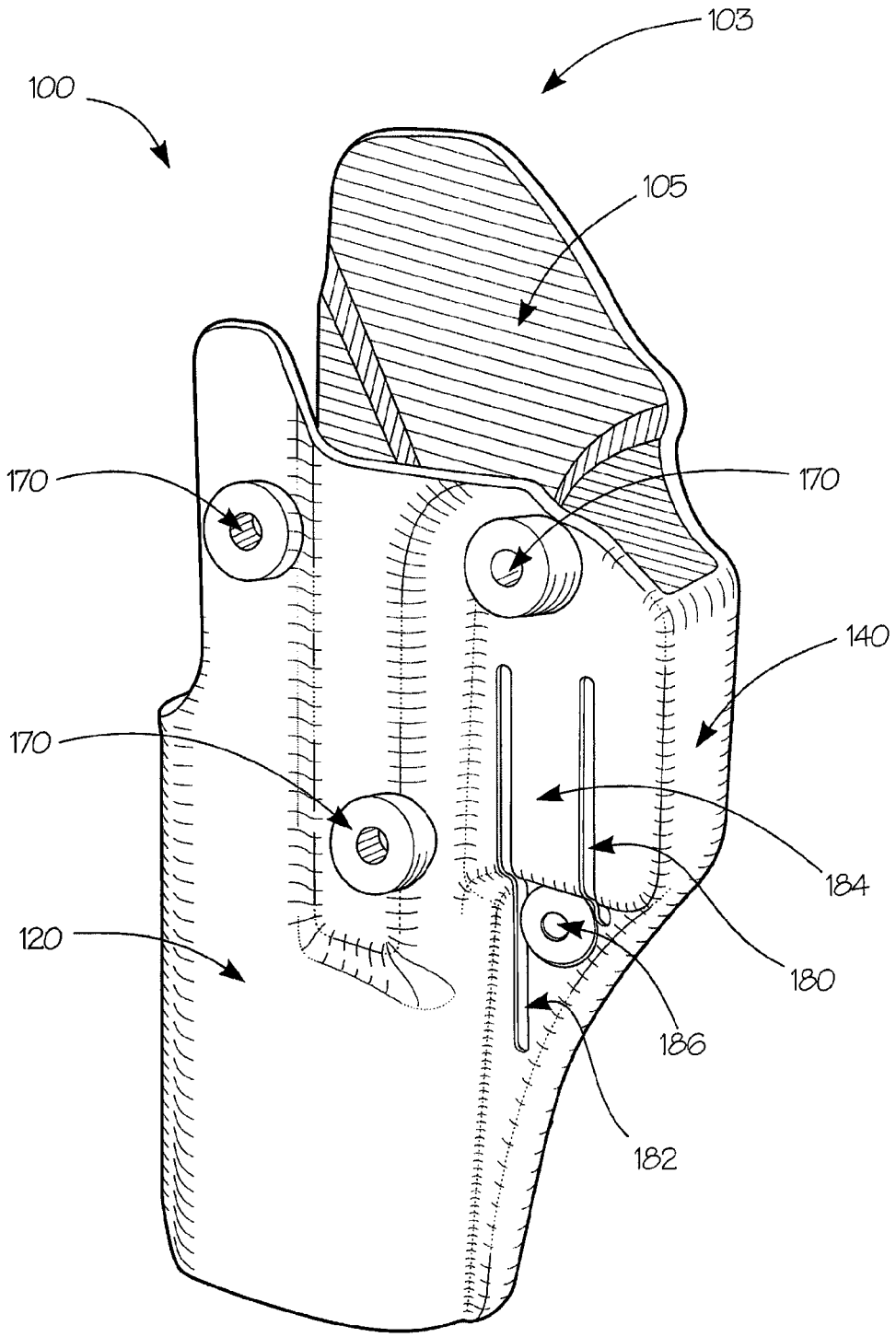
FIG. 2 shows a left perspective view of a first exemplary embodiment of a handgun holster having a retention system according to this invention.

For simplicity and clarification, the design factors and operating principles of the handgun holster according to this invention are explained with reference to various exemplary embodiments of a handgun holster according to this invention. The basic explanation of the design factors and operating principles of the handgun holster is applicable for the understanding, design, and operation of the handgun holster of this invention.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are openended linking verbs. As a result, a system, device, or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Furthermore, it should be appreciated that, for simplicity and clarification, the embodiments of this invention will be described with reference to a semiautomatic-type handgun being secured within the present holster. However, it should be appreciated that the operating principles of the handgun holster of this invention may also be employed to construct holsters or holders for any revolver or semiautomatic-type handgun, edged weapons as well as less than lethal products (i.e., tasers, pepper spray, mace canisters, or batons), so long as these items have an appropriate ledge or void that may be engaged or retained by a locking projection or other retaining means. Furthermore, it is also within the scope of the present invention that the present holster may be employed as a pouch for tactical accessories, such as ammunition magazines and/or flashlights, as well as for everyday items such as cell phones or personal digital assistants.

It should also be appreciated that the terms "handgun", "handgun holster", and "weapon" are used for basic explanation and understanding of the operation of the systems, methods, and apparatuses of this invention. Therefore, the terms "handgun", "handgun holster", and "weapon" are not to be construed as limiting the systems, methods, and apparatuses of this invention.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing Figs., FIGS. 1-9B show various views of a first, illustrative, non-limiting embodiment of a handgun holster 100 having a retention system according to this invention. It should be appreciated that the holster 100 is adapted to retain a semiautomatic-type handgun. The semi-automatic-type handgun includes a slide, a grip, a trigger, and a trigger guard. The trigger guard includes an inner surface, which defines an area wherein the trigger is located and allows a user's finger access to the trigger, and an outer surface, which defines the outer perimeter of the trigger guard.

As shown in FIGS. 1-9B, the holster 100 includes a body 103 defining a cavity 105 for receiving and holding the handgun. The body 103 comprises a pair of opposed side walls comprising a first side wall 110 and a second side wall 120. Typically, the first side wall 110 is considered the outer side of the holster and is worn away from the user's body, while the second side wall 120 is considered the inner side of the holster and is worn against or adjacent the user's body.

In various exemplary embodiments, the body 103 further comprises at least some of a front wall 130 and a rear wall 140. However, it should be appreciated that the holster 100 may be formed such that one or more of the first side wall 110, the second side wall 120, the front wall 130, and/or the rear wall 140 is/are sufficient to define the cavity 105 for receiving the handgun and the remaining walls are not included.

The cavity 105 includes an open top end 101 and a bottom end 102 and may be formed from any number or combination of walls, including, for example, a single, continuous wall or multiple coupled or joined walls. Alternatively, the cavity 105 may be formed by a material being shaped or bent in a substantial "U" shape. Thus, the cavity 105 may be formed by any cavity, space, or platform that is capable of retaining a handgun.

Figure 3:
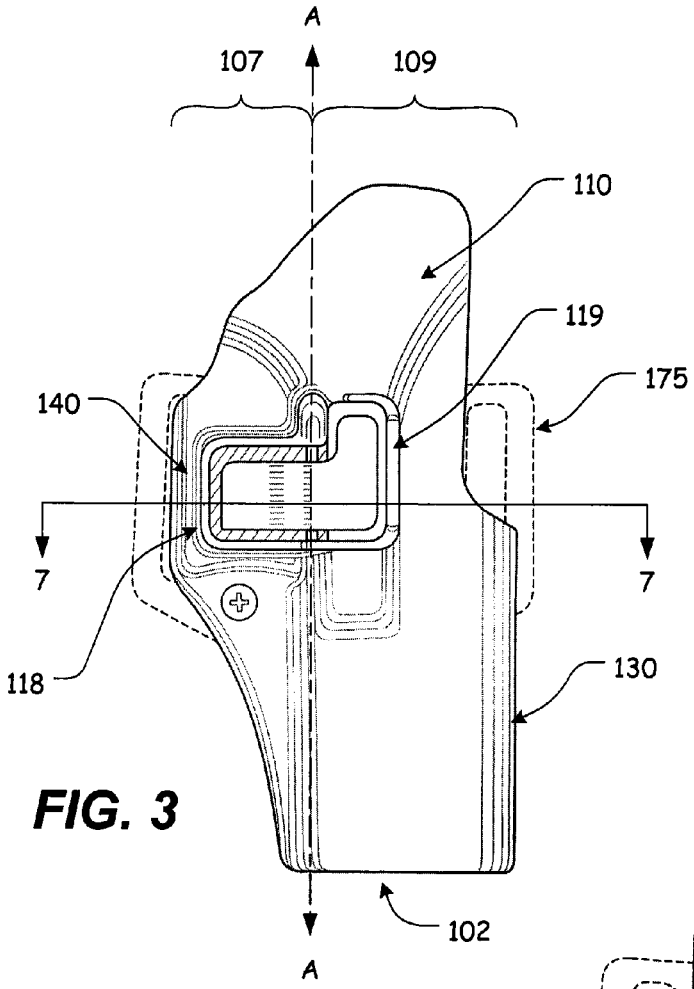
FIG. 3 shows a right side elevation view of a first exemplary embodiment of a handgun holster having a retention system according to this invention.

As identified in FIG. 3, an axis A extends generally from the top end 101 to the bottom end 102, between a frame/slide portion 109 of the cavity 105 and a trigger guard portion 107 of the cavity 105. The frame/slide portion 107 of the cavity 105 generally has greater depth than the trigger guard portion 109 of the cavity 105.

It should be noted that the walls of the holster 100 may generally be planar. Alternatively, the walls of the holster 100 may be contoured or shaped to better accommodate a specific type or model of handgun to be retained within the holster 100.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

In various exemplary embodiments, at least certain components of the holster 100 may be formed of any known or later developed, substantially flexible material(s) such as a polymeric material, leather, foam, foam laminates, natural and man-made (synthetic) fabrics, natural and man-made (synthetic) fabric laminates, moldable honeycomb materials, or the like, and/or various combinations of the foregoing.

Thus, it should be understood that the material or materials used to form the holster 100 and/or various components of the holster 100 is a design choice based on the desired appearance and functionality of the holster 100.

Figure 4:
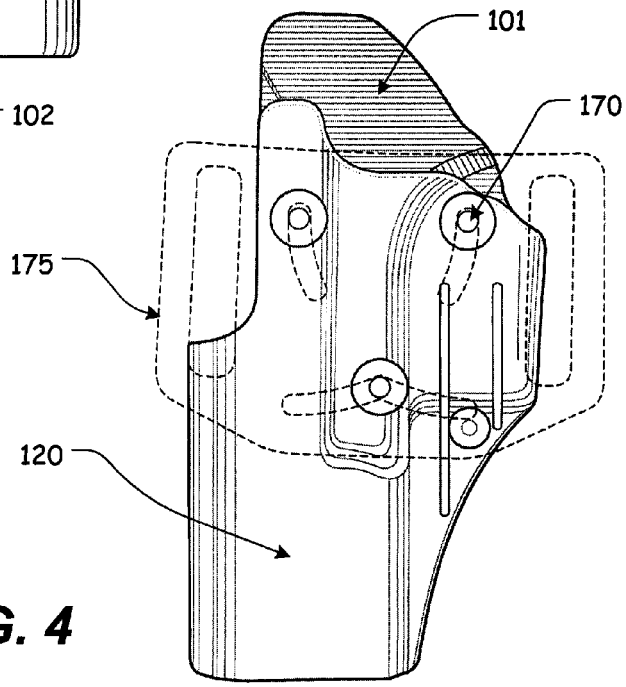
FIG. 4 shows a left side elevation view of a first exemplary embodiment of a handgun holster having a retention system according to this invention.
Figure 5:
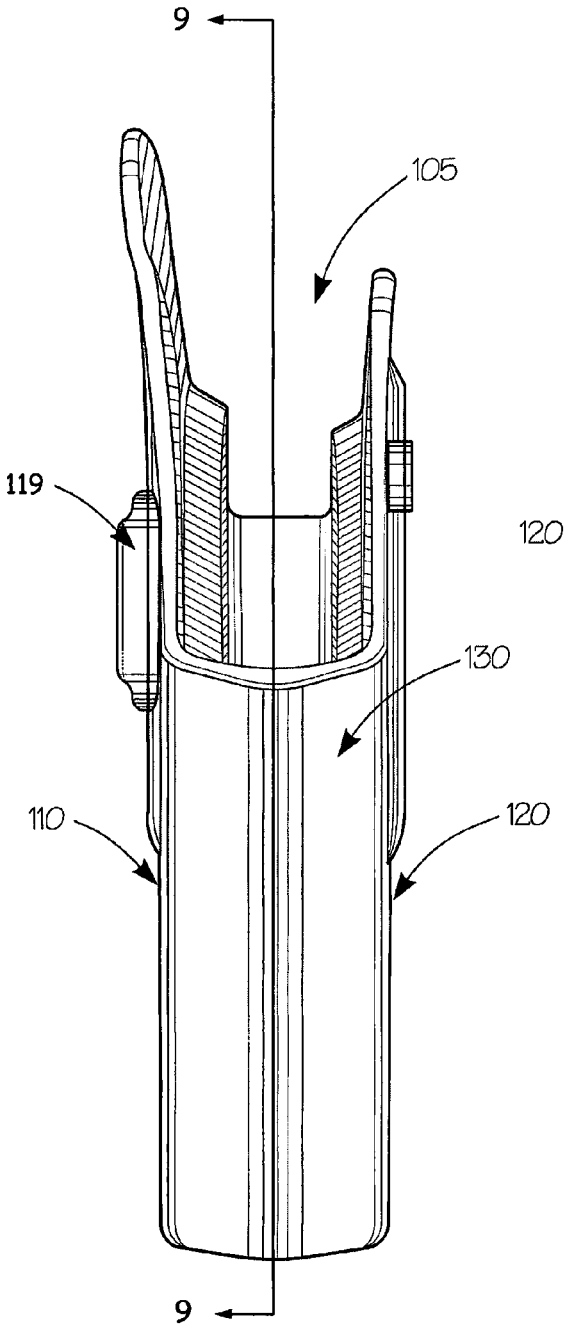
FIG. 5 shows a front elevation view of a first exemplary embodiment of a handgun holster having a retention system according to this invention.
Figure 6:
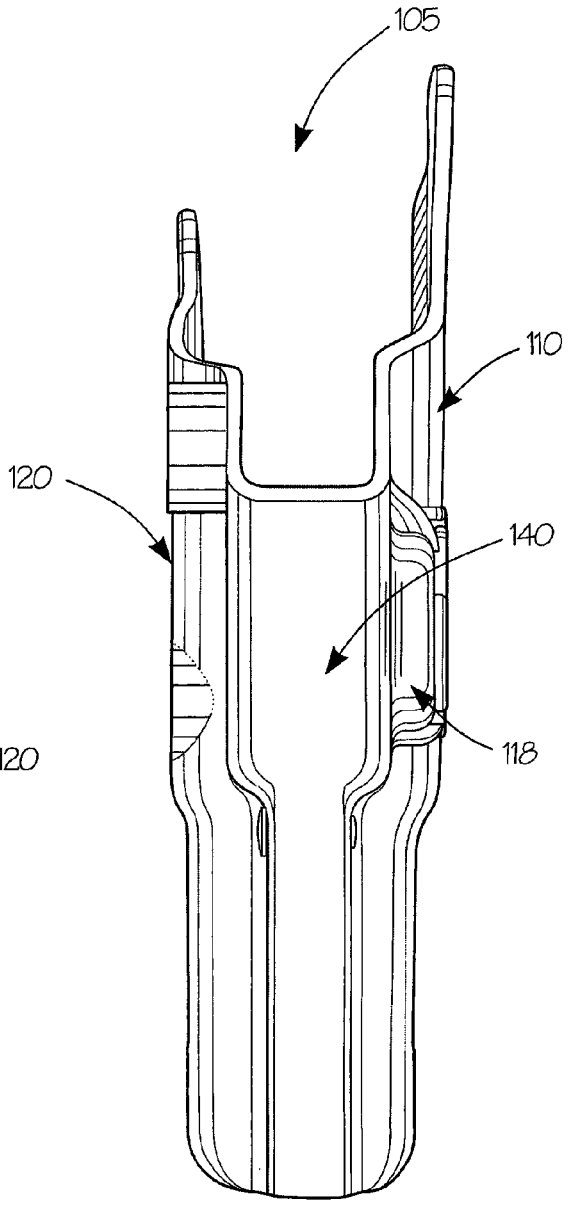
FIG. 6 shows a rear elevation view of a first exemplary embodiment of a handgun holster having a retention system according to this invention.
Figure 7:
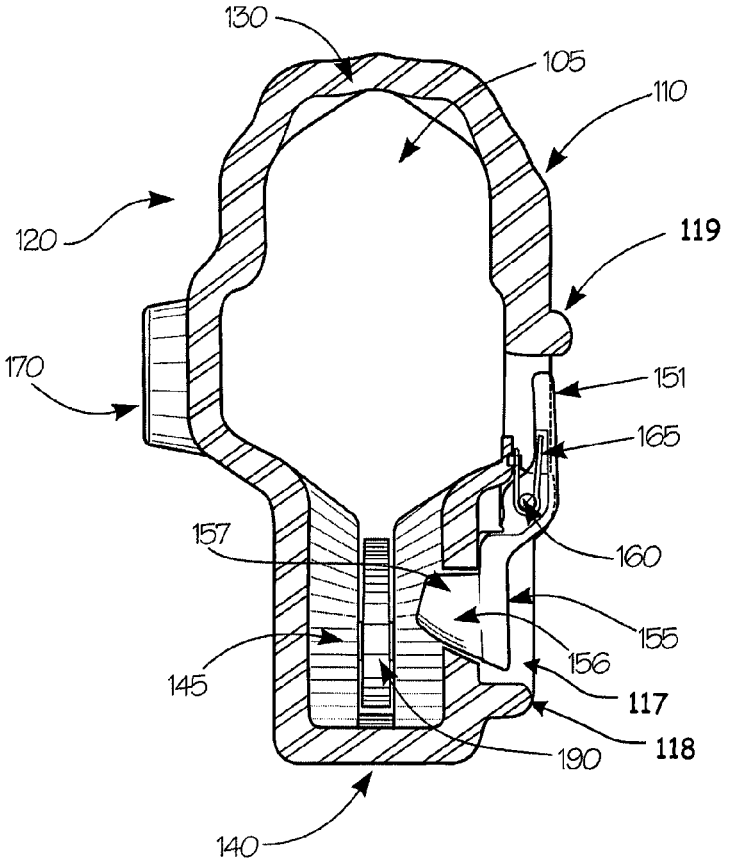
FIG. 7 shows a top cross-sectional view taken along line 7-7 of the handgun holster of FIG. 3, illustrating the first exemplary embodiment of the retention system according to this invention in greater detail.
Figure 8:
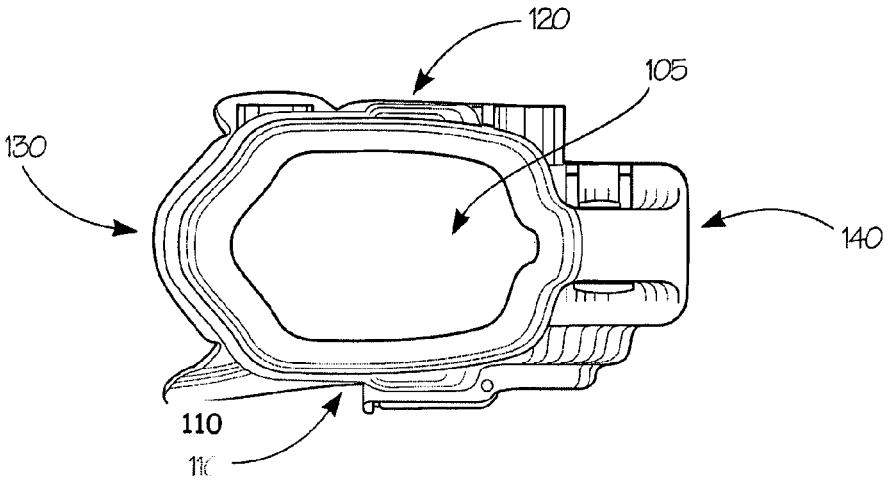
FIG. 8 shows a bottom plan view of a first exemplary embodiment of a handgun holster having a retention system according to this invention.
Figure 9A:
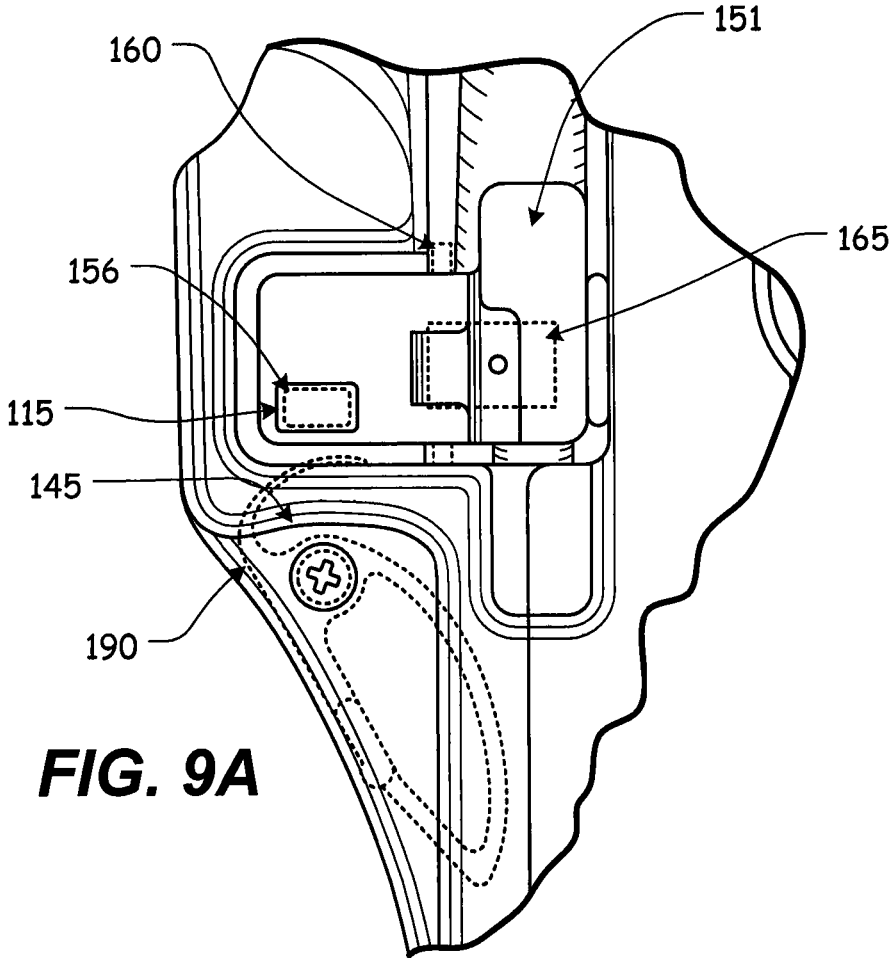
FIG. 9A shows a more detailed right side view of the handgun holster further illustrating the retention system according to this invention.
Figure 9B:
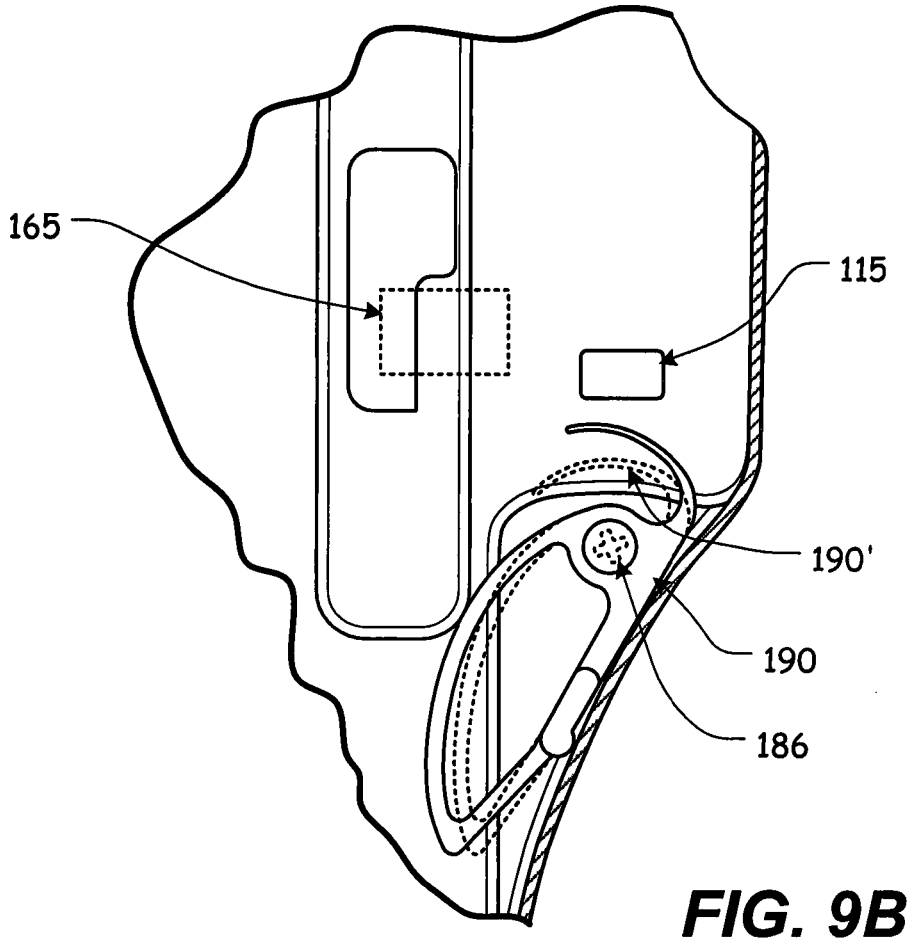
FIG. 9B shows a more detailed cross-sectional view taken along line 9-9 of the handgun holster of FIG. 5, illustrating the first exemplary embodiment of the retention system according to this invention in greater detail.

In various exemplary embodiments, the holster 100 includes attachment points 170, which provide means for fastening the holster to a holster holding device such as the holster holding device 175 illustrated in phantom in FIGS. 3 and 4. Alternatively, the means for fastening the holster may comprise a clip or hook adapted to be clipped over, for example, a belt. In further exemplary embodiments, means for fastening the holster may comprise one or more quick-disconnect or other couplings may be provided on or adjacent the second side wall 120 of the holster 100, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster to a user or the user's apparel.

In various exemplary embodiments, one or both of the side walls include optional slots 180 and 182, which define a passive retention portion 184. Although not shown in the present figures, the inner surface of the passive retention portion 184 may optionally include a raised area, which provides for additional frictional engagement of the trigger guard of the handgun. One or more retention screws 186 may be tightened or loosened to adjust the degree of frictional retention of the handgun by the passive retention portion 184.

The passive retention portion 184, if included, may be adjusted, via the one or more retention screws 186, to provide an adjustable frictional tension between the passive retention portion 184 and the handgun trigger guard, without increasing the frictional tension between a remaining portion of the holster 100 and the handgun.

As further shown in FIGS. 1-9B, the holster 100 comprises a retention means that is capable of retaining a handgun securely in the holster 100 by restricting withdrawal of the handgun from the cavity 105 of the holster 100 while permitting a quick release of the handgun when the user requires. The retention means comprises a lever 150, having a first side facing generally outward from the holster 100, away from the cavity 105 formed by the holster 100, and a second side facing toward the cavity 105 formed by the holster 100. The lever 150 comprises at least some of a finger button portion 151 and an engagement portion 155.

In various exemplary embodiments, the first side of the finger button portion 151 includes a textured portion (not shown). In this manner, the finger button portion 151 may be distinguished tactilely from other portions of the lever 150 or the holster 100.

In various exemplary, non-limiting embodiments, lever 150 is pivotally connected to the first side wall 110, approximately between the finger button portion 151 and the engagement portion 155, via a fulcrum or pivot pin 160. In various exemplary embodiments, the pivot pin 160 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the pivot pin 160 may be positioned at any angle relative to a vertical axis of the holster 100.

The pivot pin 160 may extend all or part of the way across the width of the lever 150.

In various exemplary embodiments, the lever 150 may include a first and a second protrusion extending from the lever 150. Corresponding first and second indentions, indentations, notches, grooves, or dimples may be formed in the first side wall 110. In these exemplary embodiments, the first and second protrusions are formed so as to operate in cooperating relationship with the first and second dimples such that the lever 150 may be pivotally attached, via the first and second protrusions and the first and second dimples, to the first side wall 110 approximately between a finger button portion 151 and the engagement portion 155. Thus, the pivot pin 160 is replaced by the first and second protrusions.

Alternatively, the lever 150 may include first and second dimples while the first sidewall 110 includes first and second protrusions. In these exemplary embodiments, the first and second dimples are formed so as to operate in cooperating relationship with the first and second protrusions such that the lever 150 may be pivotably attached, via the first and second dimples and the first and second protrusions, to the first side wall 110 approximately between the finger button portion 151 and the engagement portion 155.

The lever 150 is pivotable between an engaged position for securing the handgun within the cavity 105 of the holster 100 and a disengaged position for removal of the handgun. In various exemplary embodiments, the lever 150 may pivot between the engaged position and the disengaged position. Alternatively, the lever 150 may be pivotably positioned and/or retained between either the engaged position or the disengaged position.

In various exemplary embodiments, the lever 150 may be biased to an engaged position whether the handgun is present in the holster 100 or absent from the holster 100. In various exemplary embodiments, biasing of the lever 150 may be accomplished by, for example, a spring means 165.

It should be appreciated that any suitable biasing means, element, or mechanism may be used to form the spring means 165. For example, in various illustrative, non-limiting embodiments of this invention, the spring means 165 may comprise a portion of spring steel, a helical spring, a compression coil spring, a cylindrical coil spring, a conical coil spring, a tension coil spring, a leaf spring, a V-spring, a cantilever spring, a spring washer, a flexible extension of the lever 150 or the first side wall 110, a stretched or tensioned material, such as, for example, a rubber band, or any other element, material, or mechanism usable to bias the lever 150.

It should be understood that the overall size, shape, and thickness of the spring means 165 will vary depending on the type and rigidity of the particular material used to form the spring means 165.

The engagement portion 155 of the lever 150 includes a locking projection 156, formed on the second side of the engagement portion 155. In certain exemplary embodiments, the locking projection 156 optionally extends substantially perpendicularly from the second side of the engagement and 155.

In various exemplary, nonlimiting embodiments, the locking projection 156 includes a ramp surface 157 and is shaped generally to match the contour of a portion of the inner surface of the trigger guard. Alternatively, the locking projection 156 may terminate in a radiused or not radiused manner. Particularly if the trigger guard of the handgun that is to be carried within the holster 100 is itself radiused, the ramp surface 157 may not be included.

Regardless of the particular handgun used, the locking projection 156 should be shaped so that there is no possibility that the locking projection 156 can at any time contact the trigger of the handgun. When the handgun is pushed as far forward as possible into the holster 100 and the trigger guard has come to rest against the trigger guard support wall 145, there should be a space between the locking projection 156 and the trigger of the handgun.

When the lever 150 is in the engaged position, the locking projection 156 protrudes from the second side of the engagement portion 155, into the cavity 105 formed in the holster 100, via an opening 115 in the first side wall 110. In this manner, the locking projection 156 may extend inside the cavity 105 and inside the trigger guard of a handgun that is placed into the holster 100 and, thereby, retain the handgun in the holster 100.

In various exemplary embodiments, the locking projection 156 protrudes into the cavity 105 for a distance that is less than the width of the trigger guard. Alternatively, the locking projection 156 may protrude into the cavity 105 for a distance that is equal to or greater than the width of the trigger guard.

In addition, when the lever 150 is in the engaged position and is retaining a handgun in place, the clearance between the locking projection 156 and the trigger guard support wall 145 should be such that there is room for the slight arc or plunger-type movement of the locking projection 156 when the finger button portion 151 is depressed.

Thus, the retention means is automatically disengaged as the outer surface of the handgun's trigger guard contacts the locking projection 156 and is subsequently engaged when the inner surface of the trigger guard has passed the locking projection 156 and the handgun is appropriately retained in the holster 100.

As illustrated in FIGS. 1 and 3, the holster 100 can be divided, along an axis that extends from the pivot pin 160, along the first side wall 110 of the holster 100, into a frame/slide portion and a trigger guard portion. The frame/slide portion is contoured to accept at least a portion of a frame/slide of a handgun and the trigger guard portion is contoured to accept at least a portion of a trigger guard of a handgun. Thus, it can be seen that the finger button portion 151 extends into the frame/slide portion of the holster and the engagement portion 155 extends into the trigger guard portion of the holster 100.

As at least a portion of each holster 100 is formed to accommodate and securely retain a specific type of handgun. The construction of the holster 100 also prevents the locking projection 156 from contacting the trigger of the inserted handgun by limiting how far the handgun can be inserted into the holster 100.

In various exemplary embodiments, a trigger guard support wall 145 is generally formed by a portion of the body of the holster 100. The trigger guard support wall 145 is shaped generally to match the contours of at least a portion of the outer surface of the trigger guard. The trigger guard support wall 145 is formed so as to contact at least a portion of the outer surface of the trigger guard of the inserted handgun and further limit how far the handgun can be inserted into the holster 100.

The construction of the holster 100 further facilitates alignment of the trigger guard with the locking projection 156 by limiting lateral movement of the handgun with respect to the lever 150 and the locking projection 156 without preventing a user from easily holstering or drawing the handgun.

In various exemplary embodiments, an optional ridge 118 is formed in the first side wall 110 around at least a portion of the lever 150. Generally, the ridge does not contact the lever 150, but provides a perimeter around at least a portion of the lever 150 to reduce the likelihood that the lever 150 will be inadvertently manipulated and to aid in the proper placement of a user's finger on the finger button portion 151 of the lever 150. The ridge 118 may include a textured portion (not shown), such that the ridge 118 may be distinguished tactilely from other portions of the holster 100 or the lever 150. The ridge 118 may include a gap or valley formed so as to accommodate a user's finger if the finger would extend beyond the finger button portion 151 of the lever 150.

In various exemplary embodiments, the optional ridge 118 is comprised of at least one ridge segment 118 and/or 119 that are formed around at least a portion of the lever 150.

In various exemplary embodiments, a recess 117 is defined within the optional ridge 118 or ridge segments 118 and/or 119.

Although FIGS. 1-9B show the lever 150 connected to the first side wall 110, it should be appreciated that in various exemplary embodiments, the lever 150 may be connected to the second side wall 120.

In an illustrative, non-limiting embodiment of this invention, a biasing element 190 is optionally included. If included, the biasing element 190 extends towards the locking projection 156, covering substantially the entire distance between the trigger guard support wall 145 and the locking projection 156. In various exemplary embodiments, the biasing element 190 does not touch the locking projection 156.

It should be appreciated that any suitable spring mechanism may be used to form the biasing element 190. The overall size, shape, and thickness of the biasing element 190 will vary depending on the type and rigidity of the particular material used to form the biasing element 190.

The biasing element 190 is configured to contact the outer surface of the trigger guard and is spring-biased (as shown in phantom by 190') when the handgun is retained, or locked, in the holster. In a compressed position, the tension of the biasing element 190 biases the handgun outward and assists in maintaining contact between the locking projection 156 and the inner surface of the trigger guard.

Furthermore, the biasing element 190 may assist in removal of the handgun from the holster when the locking projection is disengaged from the trigger guard.

The biasing element 190 may be configured in a number of ways, and may be attached to the holster 100 by any suitable method. In one exemplary embodiment, the biasing element 190 is molded as an integral part of the holster 100.

An aperture 116 is formed in a portion of the first side wall 110, within the recess 117, beneath at least a portion of the finger button portion 151 of the lever 150. Among other things, the aperture 116 allows dirt and/or debris that may find its way under the finger button portion 151 of the lever 150 to be pushed into the cavity 105. In this manner, dirt and/or debris is not permitted to build up underneath the finger button portion 151 of the lever 150 and keep the finger button portion 151 from being depressed by a user.

During use of the holster 100 having a retention system, as a user begins to holster the handgun, the handgun is inserted into the cavity 105 of the holster, muzzle first, and is guided into position by at least some of the first side wall 110, the second side wall 120, the front wall 130, and the rear wall 140.

As the handgun is inserted further into the cavity 105, the outer surface of the trigger guard will contact the ramp surface 157 of the locking projection 156. The shape of the ramp surface 157 allows the locking projection 156 to ride along the surface of the trigger guard and displace the locking projection 156 of the lever 150. As the locking projection 156 rides along the surface of the trigger guard, the bias of the lever 150 is overcome and the lever 150 is pivoted towards the disengaged position and the handgun is permitted to be seated in the cavity 105 of the holster. The trigger guard is prevented from moving in a direction opposite the locking projection 156 by the position of the first side wall 110 and the second side wall 120.

As the handgun is further seated into the holster, the trigger guard continues to displace the locking projection 156 and the lever 150 continues to pivot until the trigger guard passes a point of contact with a farthest extent of the locking projection 156 and clears the locking projection 156. When the trigger guard passes the locking projection 156, the lever 150 may be biased, via the spring means 165, to pivot back to the engaged position.

Thus, the handgun is secured in the cavity 105 of the holster by operation of the locking projection 156 blocking removal of the handgun, via the inner surface of the trigger guard. While the handgun is fully seated in the cavity 105 of the holster 100 with the lever 150 biased to the engaged position, removal of the handgun is not permitted, as the locking projection 156 does not allow the trigger guard to pass by. When the handgun is secured in place, removal force applied to the handgun will not remove the handgun from the holster 100 unless the finger button portion 151 is pivoted and the locking projection 156 is brought out of the way of the inner surface of the trigger guard.

In order to release and unholster the handgun, the user depresses the finger button portion 151 of the lever 150, pivoting the finger button portion 151 towards the cavity 105. At some point, the first side wall 110 will stop the inward movement of the finger button portion 151, thus eliminating the possibility that the finger button portion 151 can prevent the removal of the handgun by contacting the trigger or constricting the trigger guard.

As the finger button portion 151 of the lever 150 is depressed, the bias of the lever 150 is overcome, the lever 150 is pivoted towards the disengaged position, and the locking projection 156 of the engagement portion 155 is at least partially withdrawn from the opening 115 and out of the holster cavity 105.

When the finger button portion 151 has been depressed sufficiently, such that the locking projection 156 of the engagement portion 155 is sufficiently withdrawn from the holster cavity 105, such that the locking projection 156 clears the inner surface of the trigger guard, the handgun's trigger guard will no longer be blocked by the locking projection 156, and the handgun can be withdrawn from the holster 100.

In various exemplary embodiments wherein the first side wall 110 is worn away from the user's body and the second side wall 120 is worn adjacent the user's body, the finger button portion 151 may be positioned such that, as the finger button portion 151 is depressed, the user's index finger is positioned along the frame of the handgun, between the trigger guard and the slide. Therefore, as the handgun is withdrawn from the holster 100 the user's index finger is positioned to contact the frame of the handgun, above the trigger guard, and not the trigger guard or the trigger.

The holster 100, as shown and described with reference to FIGS. 1-9B, is oriented such that the first side wall 110 is worn away from the user's body and the second side wall 120 is worn adjacent the user's body, such that the lever 150 is generally accessible by the user's index finger. However, in various other exemplary embodiments, the first side wall 110 is oriented to be worn adjacent the user's body and the second side wall 120 is oriented to be worn away from the user's body. In these exemplary embodiments, the lever 150 is generally accessible by the user's thumb.

Figure 10A:
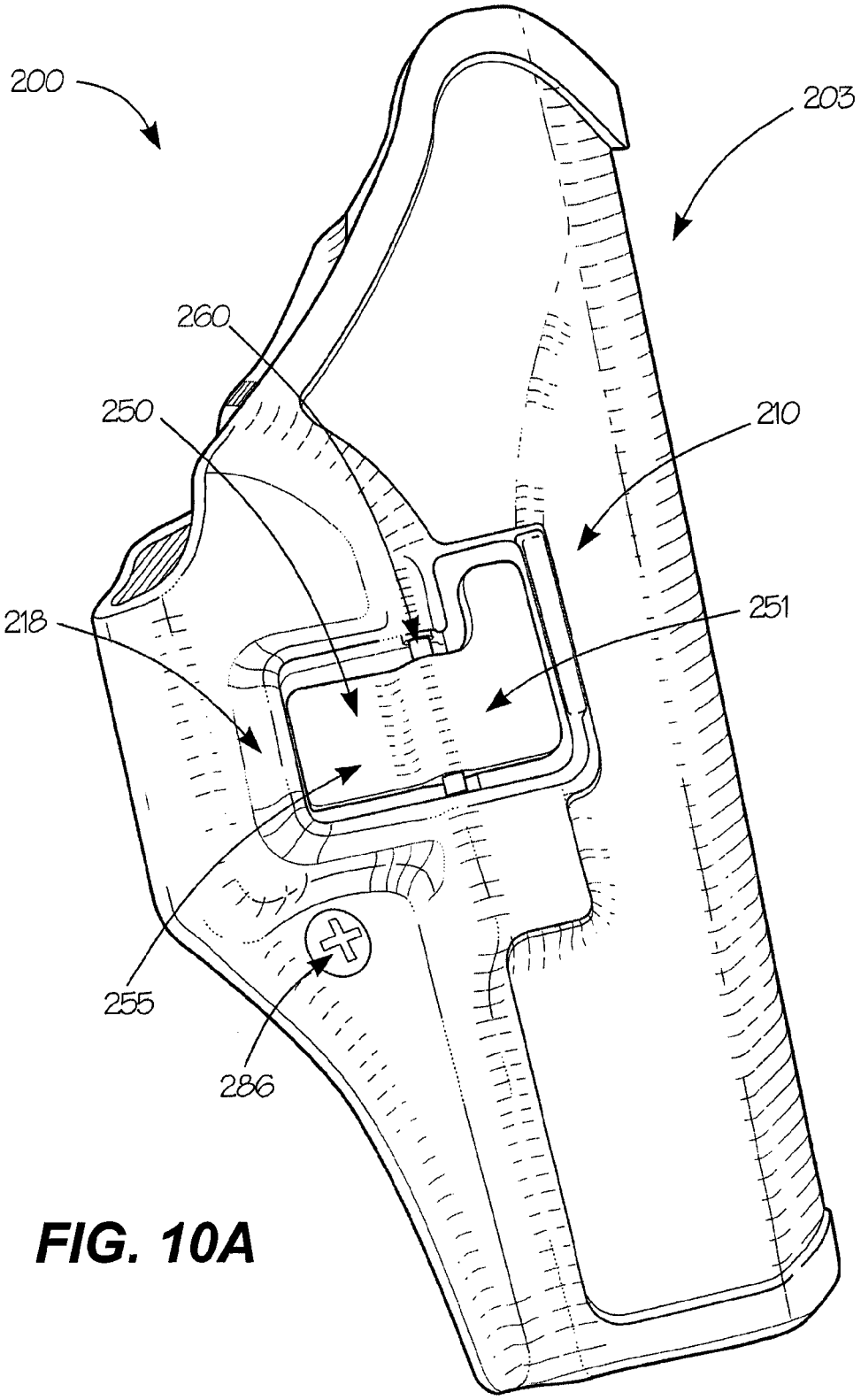
FIG. 10A shows a right perspective view of a second exemplary embodiment of a handgun holster having a retention system according to this invention.
Figure 10B:
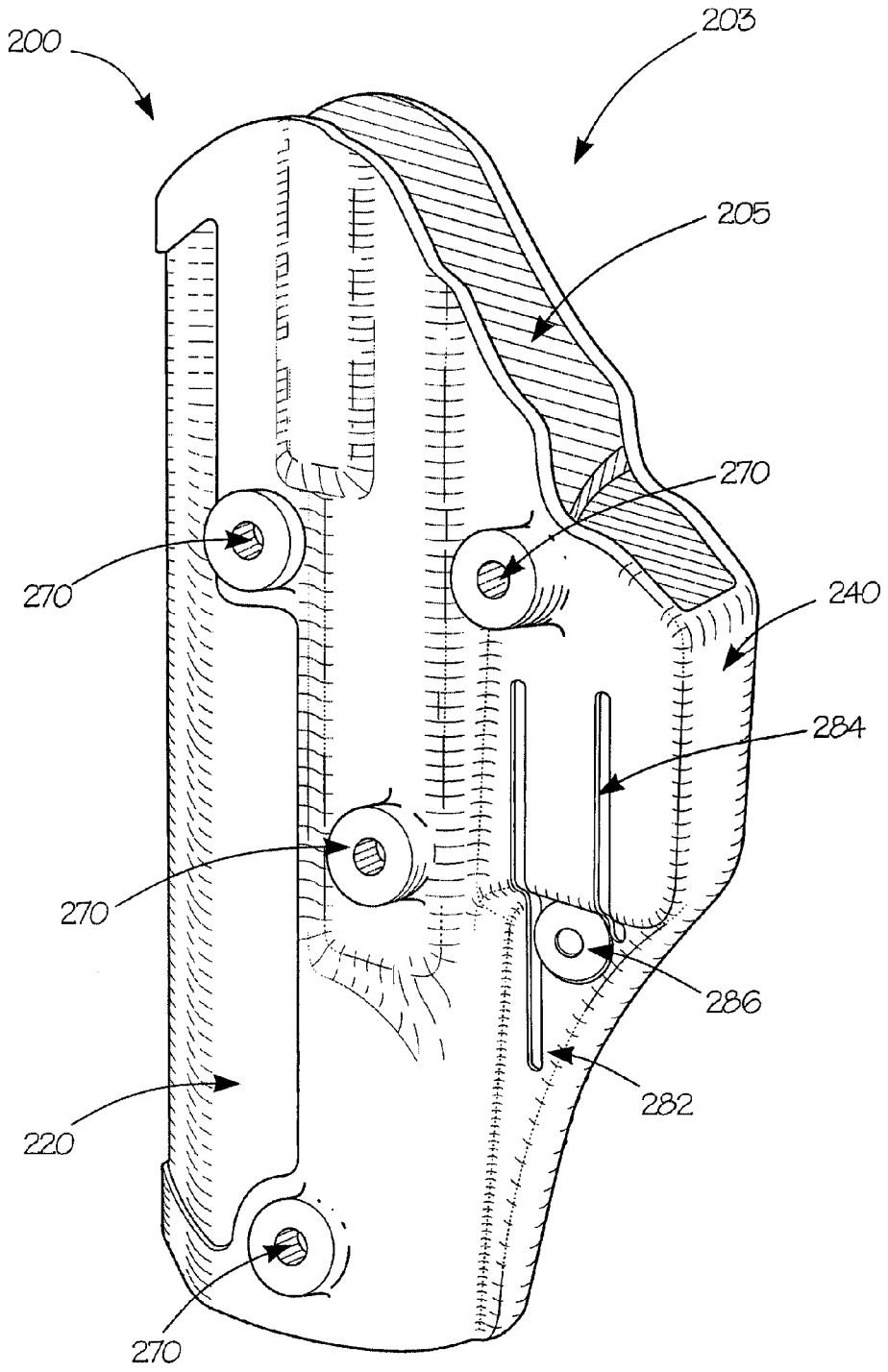
FIG. 10B shows a left perspective view of a second exemplary embodiment of a handgun holster having a retention system according to this invention.

FIGS. 10A and 10B show a right perspective view and a left perspective view, respectively, of a second exemplary embodiment of a handgun holster 200 having a retention system according to this invention. As shown in FIGS. 10A and 10B, the handgun holster 200 includes a body 203 defining a cavity 205 for receiving and holding the handgun. The body 203 comprises a pair of opposed side walls comprising a first side wall 210, an optional ridge 218 and/or ridge segments 218 and/or 219, a second side wall 220, a front wall 230, and a rear wall 240. The handgun holster 200 further comprises attachment points 270, optional slots 284 and 282, a passive retention screw 286, and a retention means comprising a lever 250.

It should be understood that each of these elements corresponds to and operates similarly to the body 103, the cavity 105, the first side wall 110, the optional ridge 118 and/or ridge segments 118 and/or 119, the second side wall 120, the front wall 130, the rear wall 140, the attachment points 170, the optional slots 180 and 182, the passive retention screw 186, the retention means, and the lever 150, as described above with reference to FIGS. 1-9B.

However, as shown in FIGS. 10A and 10B, the first side wall 210, the second side wall 220, and the front wall 230 of the handgun holster are extended, as compared to the holster 100.

The extended first side wall 210, second side wall 220, and front wall 230 perform at least three functions. First, the extended walls more fully surround and protect the handgun when the handgun is secured in the holster 200. Second, the extended walls serve to help better guide a handgun into the holster 200. Third, the extended walls serve to add a measure of strength and rigidity to the entire structure of the holster 200.

Figure 11A:
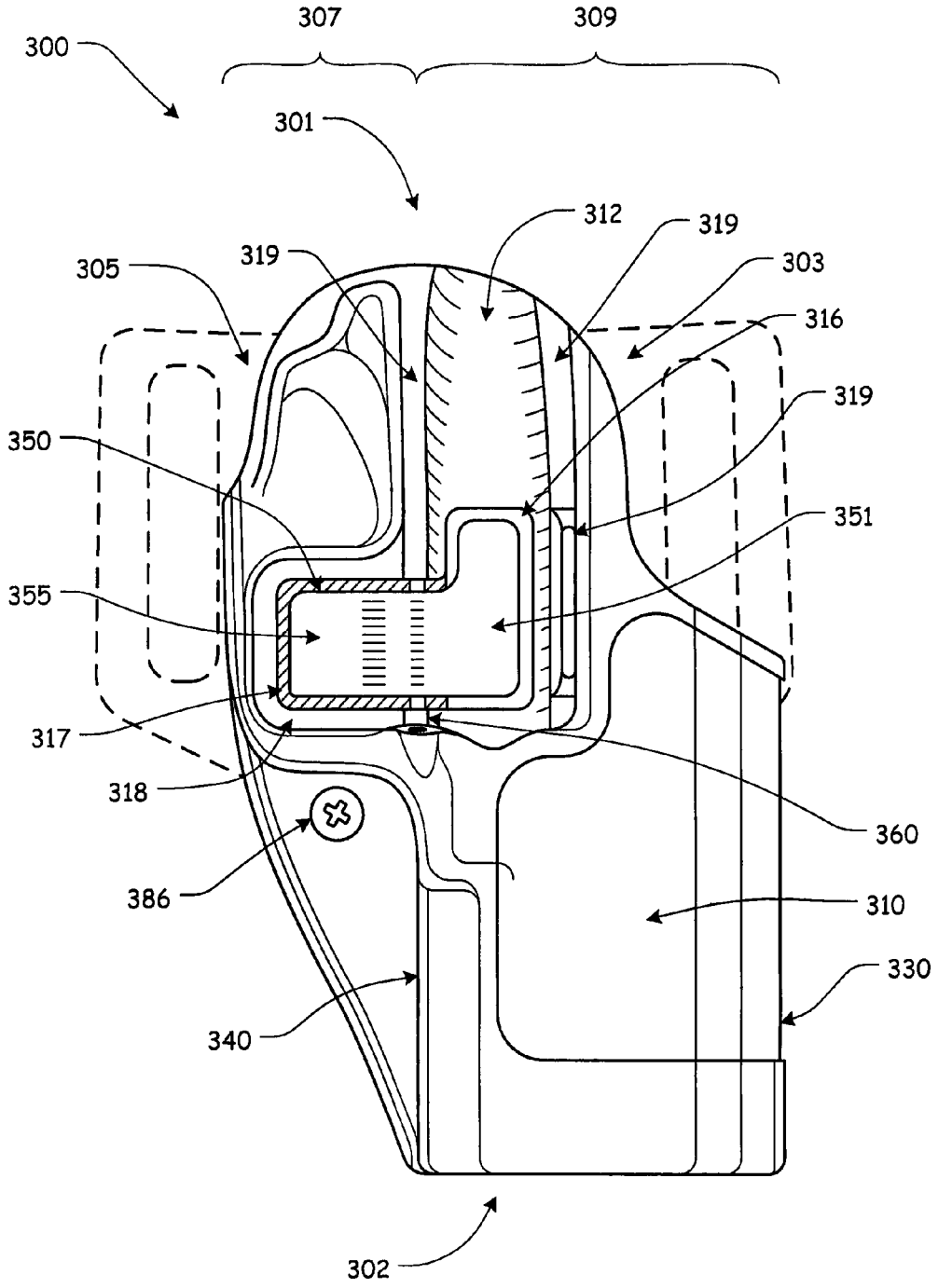
FIG. 11A shows a right side elevation view of a third exemplary embodiment of a handgun holster having a retention system according to this invention.
Figure 11B:
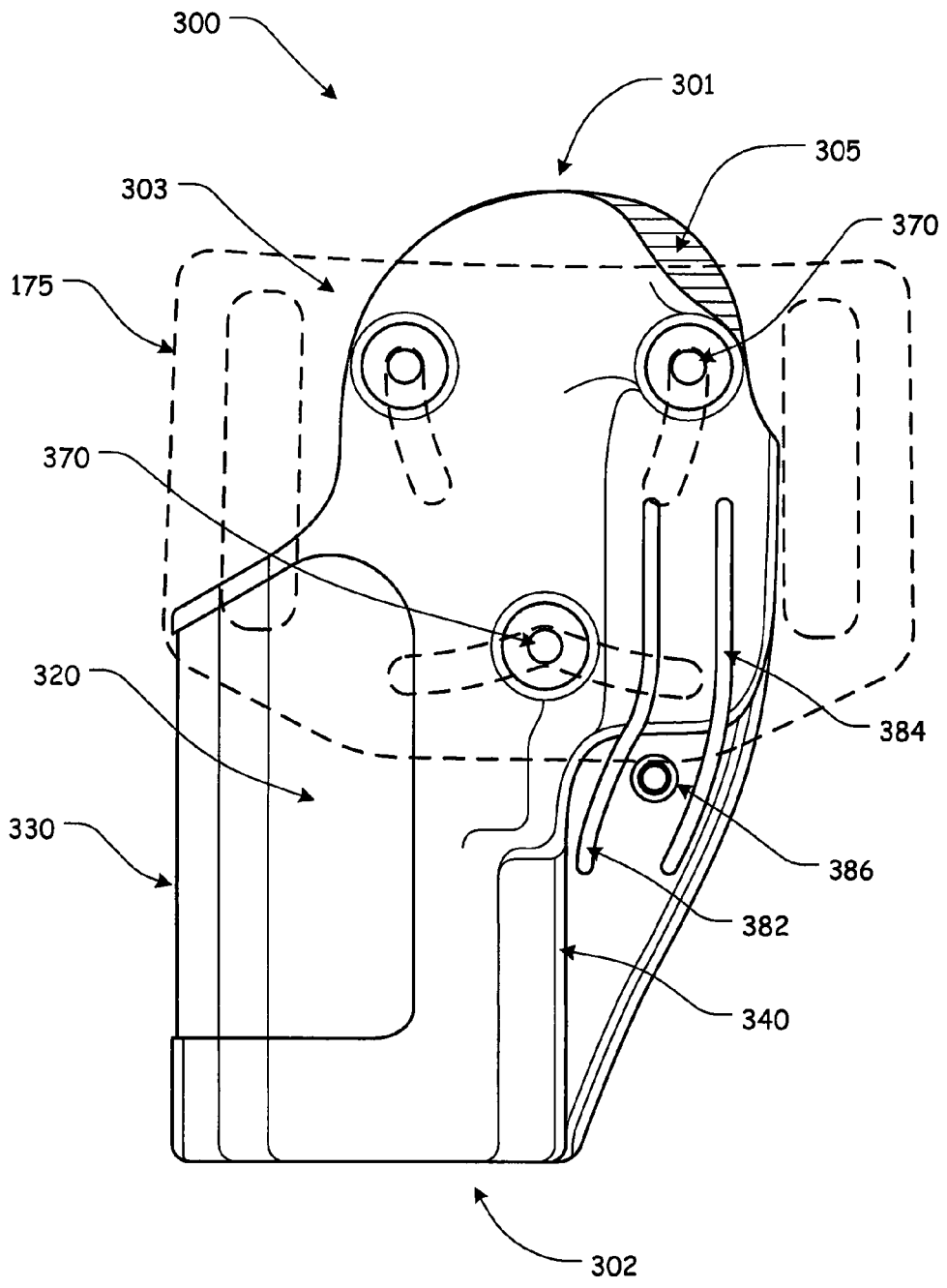
FIG. 11B shows a left side elevation view of a third exemplary embodiment of a handgun holster having a retention system according to this invention.

FIGS. 11A and 11B show a right perspective view and a left perspective view, respectively, of a second exemplary embodiment of a handgun holster 300 having a retention system according to this invention. As shown in FIGS. 11A and 11B, the handgun holster 300 includes an open top end 301 and a bottom end 302. The handgun holster 300 further includes a body 303 defining a cavity 305 (having a trigger guard portion 307 and a frame/slide portion 309) for receiving and holding the handgun.

The body 303 comprises a pair of opposed side walls comprising a first side wall 310, an aperture 316, a recess 317, an optional ridge 318 and/or ridge segments 318 and/or 319, a second side wall 320, a front wall 330, and a rear wall 340. The handgun holster 300 further comprises attachment points 370, optional slots 384 and 382, a passive retention screw 386, optionally the biasing element 390, and a retention means comprising a lever 350 having a finger button portion 351 and an engagement portion 355. The lever 350 is pivotally connected, via a pivot pin 360, to the first side wall 310.

It should be understood that each of these elements corresponds to and operates similarly to the body 103 and/or 203, the cavity 105 and/or 205, the first side wall 110 and/or 210, the aperture 116 and/or 216, the recess 117 and/or 217, the optional ridge 118 and/or 218, the optional ridge segments 118 and/or 119 and/or 218 and/or 219, the second side wall 120 and/or 220, the front wall 130 and/or 230, the rear wall 140 and/or 240, the pivot pin 160 and/or 260, the attachment points 170 and/or 270, the optional slots 180 and 182 and/or 280 and 282, the passive retention screw 186 and/or 286, the retention means, the optional biasing element 190 and/or 290 (not shown), and the lever 150 and/or 250 having the finger button portion 151 and/or 251 and the engagement portion 155 and/or 255, as described above with reference to FIGS. 1-10B.

However, as shown in FIGS. 11A and 11B, the first side wall 310, the second side wall 320, and the front wall 330 of the handgun holster 300 are slightly different from the respective side walls and front wall of the handgun holsters 100 and 200.

Additionally, as shown in FIGS. 11A and 11B, the optional ridge segments 319 extend from the finger button and 355 of the lever 350 to the top of the first side wall 310. A trough 312 is formed between the ridge segments 319, so as to further aid in the proper placement of a user's finger on the finger button portion 351 of the lever 350. It should be should appreciate that the ridge segments 319 may include a textured portion (not shown), such that the ridge segments 319 may be distinguished tactilely from other portions of the holster 300 or the lever 350.

FIGS. 12A-14 show various views of a handgun holster 400 having a retention system that includes a lockout lever 491 and the various components the lockable holster retention system of this invention. As shown in FIGS. 12A-14, the handgun holster 400 includes an open top end 401 and a bottom end 402. The handgun holster 400 further includes a body 403 defining a cavity 405 (having a trigger guard portion 407 and a frame/slide portion 409) for receiving and holding the handgun.

The body 403 comprises a pair of opposed side walls comprising a first side wall 410, a trough 412, an aperture 416, a recess 417, an optional ridge 418 and/or ridge segments 418 and/or 419, a second side wall 420 (not shown), a front wall 430, and a rear wall 440. The handgun holster 400 further comprises attachment points 470 (not shown), optional slots 484 and 482 (not shown), a passive retention screw 486, optionally the biasing element 490 (not shown), and a retention means comprising a lever 450 having a finger button portion 451 and an engagement portion 455. The lever 450 is pivotally connected, via a pivot pin 460, to the first side wall 410.

It should be understood that each of these elements of the holster 400 shown in FIGS. 12A-14 correspond to and operate similarly to the elements of holsters 100-300, as described above with reference to FIGS. 1-11B. However, as illustrated in FIGS. 12A-14, the first side wall 410, the second side wall 420 (not shown), and the front wall 430 of the handgun holster 400 are slightly different from the respective side walls and front wall of the handgun holsters 100-300.

Figure 12A:
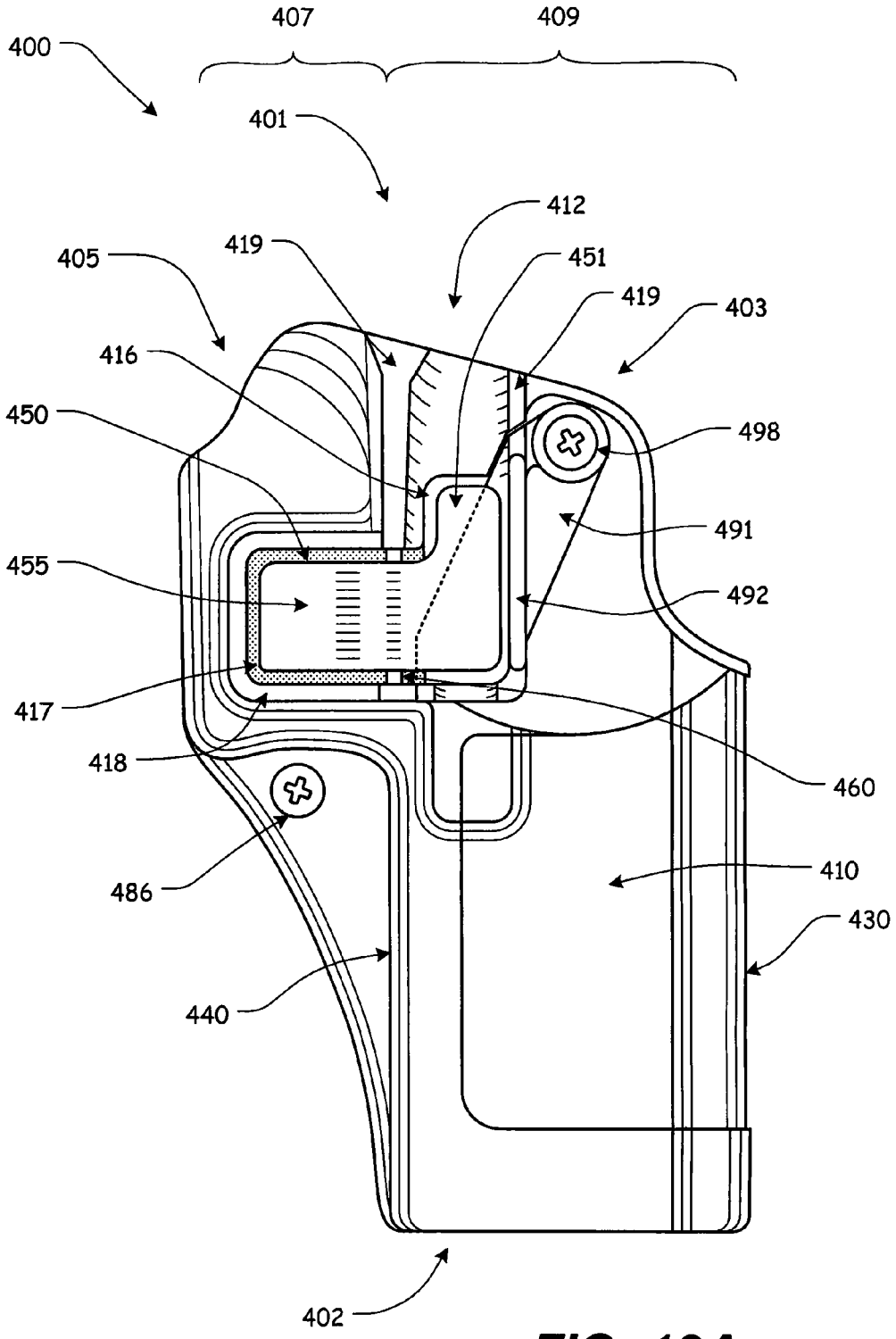
FIG. 12A shows an exemplary embodiment of a handgun holster having a retention system that includes a lockout lever, wherein the lockout lever is in a locked position according to this invention.
Figure 12B:
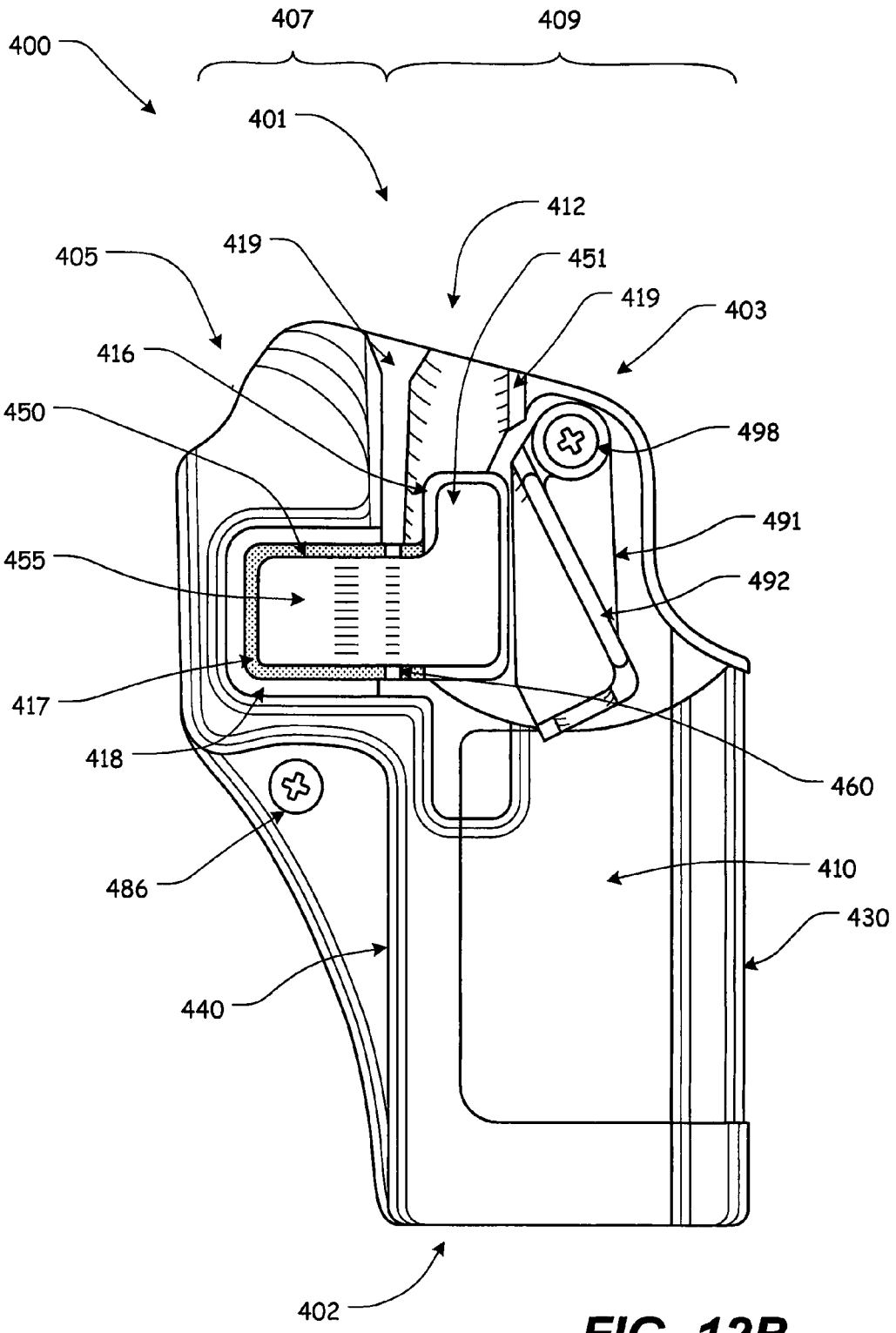
FIG. 12B shows an exemplary embodiment of a handgun holster having a retention system that includes a lockout lever, wherein the lockout lever is in an unlocked position according to this invention.

However, as shown in FIGS. 12A-14, a lockout lever 491 is pivotably attached, via a screw or pivot pin 498, to the first side wall such that the lockout lever 491 is able to be rotated between a locked position (as illustrated in FIG. 12A) and an unlocked position (as illustrated in FIG. 12B).

Figure 13A:
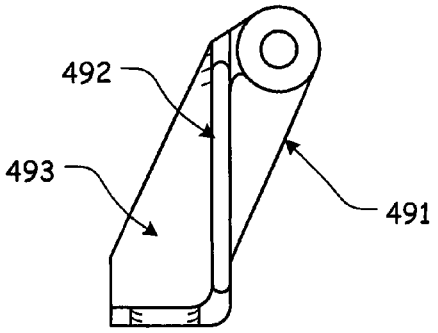
FIG. 13A show more detailed views of the front side of the lockout lever according to this invention.
Figure 13B:
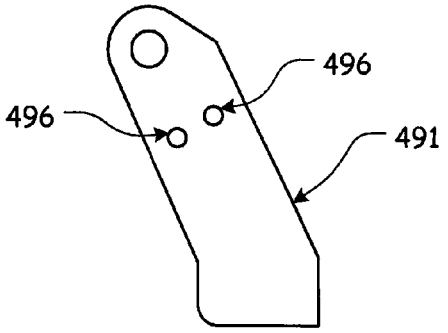
FIG. 13B show more detailed views of the back side of the lockout lever according to this invention.
Figure 14:
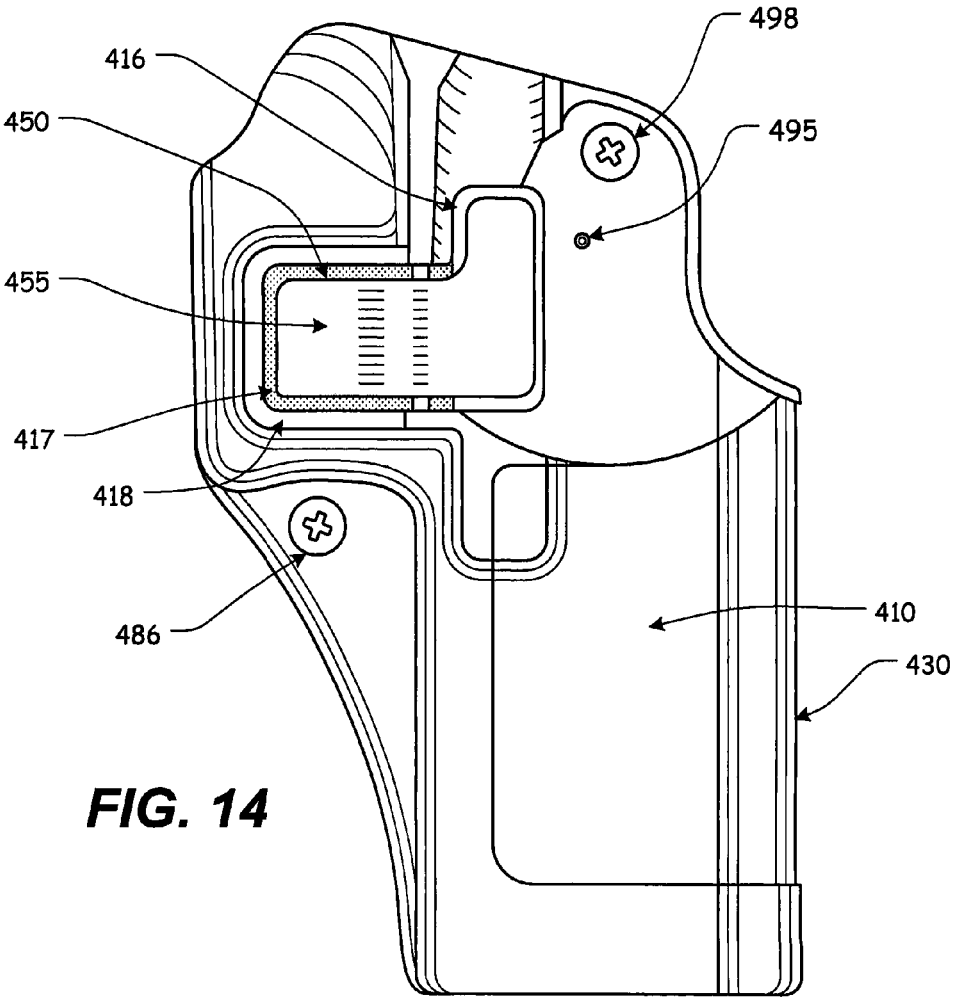
FIG. 14 shows an exemplary embodiment of a handgun holster having a retention system that may be used with a lockout lever, wherein the lockout lever is removed to show the are under the lockout lever.

As illustrated in FIG. 13A, the lockout lever 491 includes a finger engaging portion or ridge 492 that can be engaged or urged by a user's finger to pivot or rotate the lockout lever 491 between the locked and unlocked positions.

The lockout lever 491 includes a locking portion 493 that, when the lockout lever 491 is in the locked position (as illustrated in FIG. 12A), extends below the finger button portion 451 of the release lever 450 to block the finger button portion 451 of the release lever 450 and keep the release lever 450 from being pivoted to the disengaged position, if an attempt is made to pivot the release lever 450 from the engaged to the disengaged position.

When the lockout lever 491 is in the unlocked position (as illustrated in FIG. 12B), the locking portion of the lockout lever 491 is withdrawn from beneath the finger button portion 451 of the release lever 450 so as to allow the finger button portion 451 of the release lever 450 to be pivoted to the disengaged position.

In certain exemplary embodiments, the lockout lever 491 is freely rotatable between the locked position and the unlocked position. Alternatively, the lockout lever 491 may be frictionally maintained, by, for example, frictional engagement between the holster body 403 and the lockout lever 491, in either the locked or the unlocked position unless a force is applied, i.e., by a user's finger, to slide the lockout lever 491 to the locked or unlocked position. In various exemplary embodiments, frictional engagement between the surfaces of the holster body 403 and the lockout lever 491 works to maintain the lockout lever 491 in a desired position.

In other exemplary embodiments, one or more mating protrusions 495 and/or detents 496 (as illustrated most clearly in FIGS. 13B and 14), or other means may be provided to maintain the lockout lever 491 in the locked or unlocked position.

In order for a user to depresses the finger button portion 451 of the release lever 450 a sufficient distance to pivot the release lever 450 to the disengaged position, the lockout lever 491 must be in the unlocked position (as illustrated in FIG. 12B). If the lockout lever 491 is in the locked position (as illustrated in FIG. 12A), the locking portion 493 is positioned so as to contact a bottom surface of the finger button portion 451 and block the finger button portion 451 of the release lever 450 and keep the release lever 450 from being pivoted to the disengaged position.

In various exemplary embodiments, the lockout lever 491 may include one or more lockout apertures (not shown). If included, the lockout apertures allow a lock or other device to be positioned within a portion of the locking portion to maintain the lockout lever 491 in the locked or unlocked position.

Figure 15A:
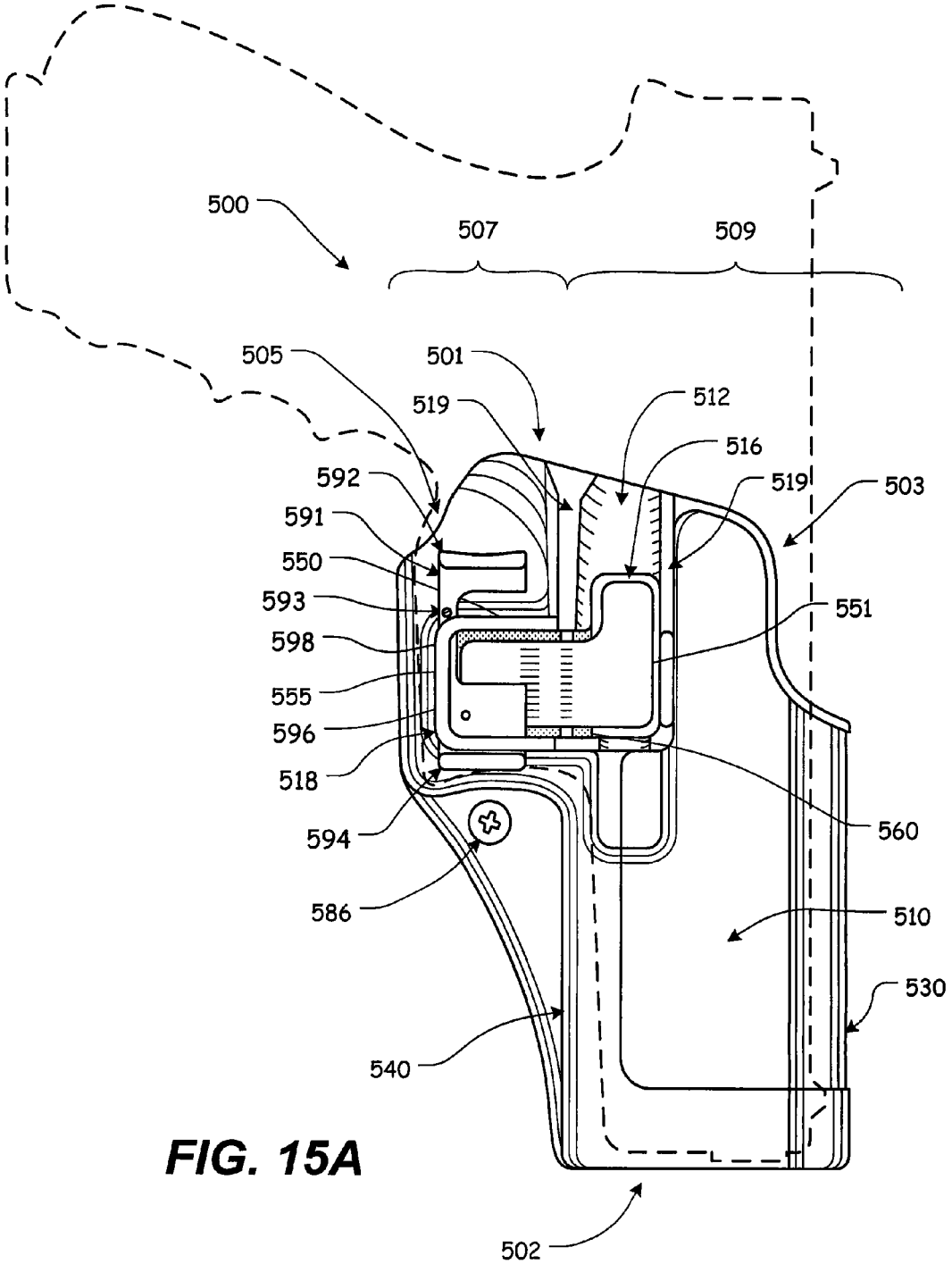
FIG. 15A shows an exemplary embodiment of a handgun holster having a retention system, showing a locking slider in a locked position according to this invention.
Figure 15B:
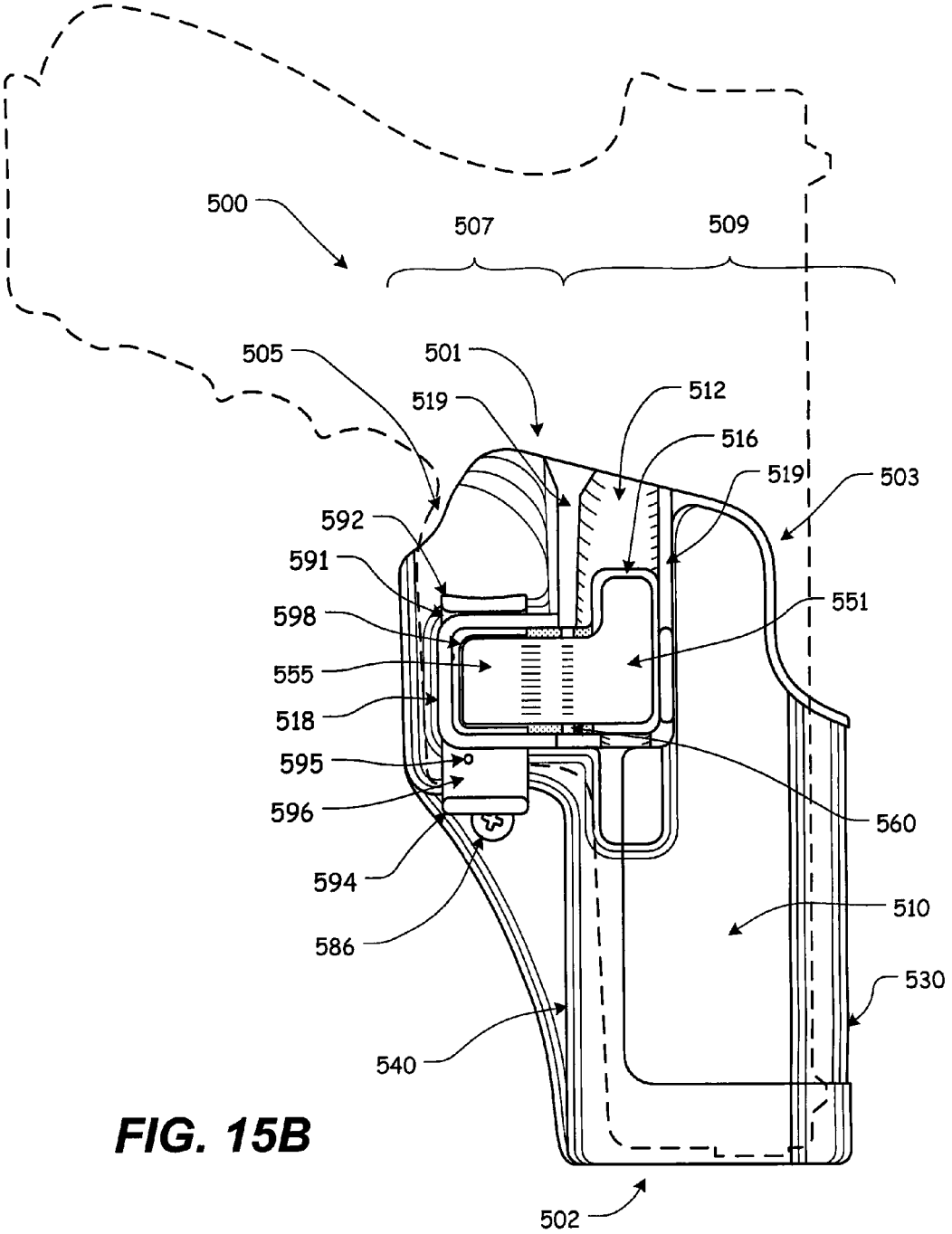
FIG. 15B shows an exemplary embodiment of a handgun holster having a retention system, showing the locking slider in an unlocked position according to this invention.
Figure 16A:
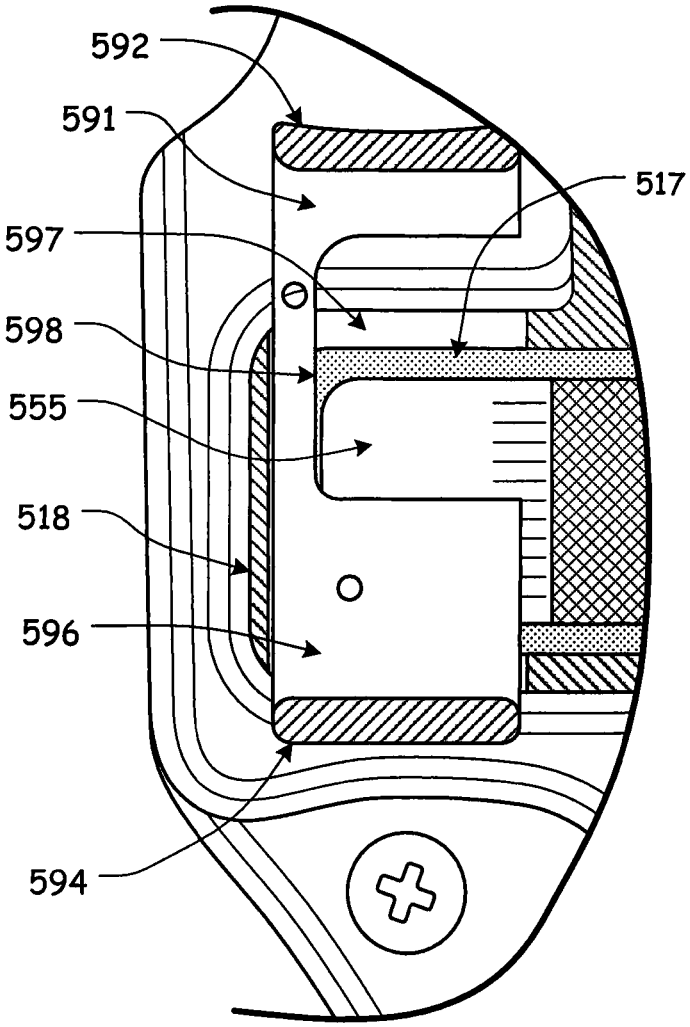
FIG. 16A shows a more detailed, cross-sectional view of the retention system of the exemplary embodiment of a handgun holster having a retention system and a locking slider, showing the locking slider in a locked position according to this invention.
Figure 16B:
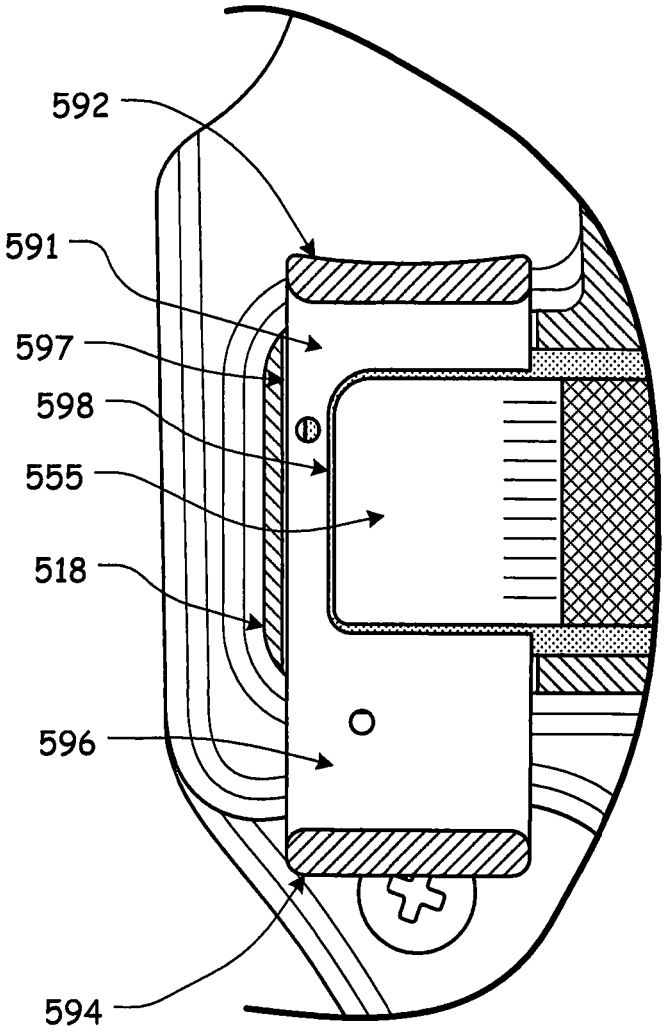
FIG. 16B shows a more detailed, cross-sectional view of the retention system of the exemplary embodiment of a handgun holster having a retention system and a locking slider, showing the locking slider in an unlocked position according to this invention.
Figure 17:
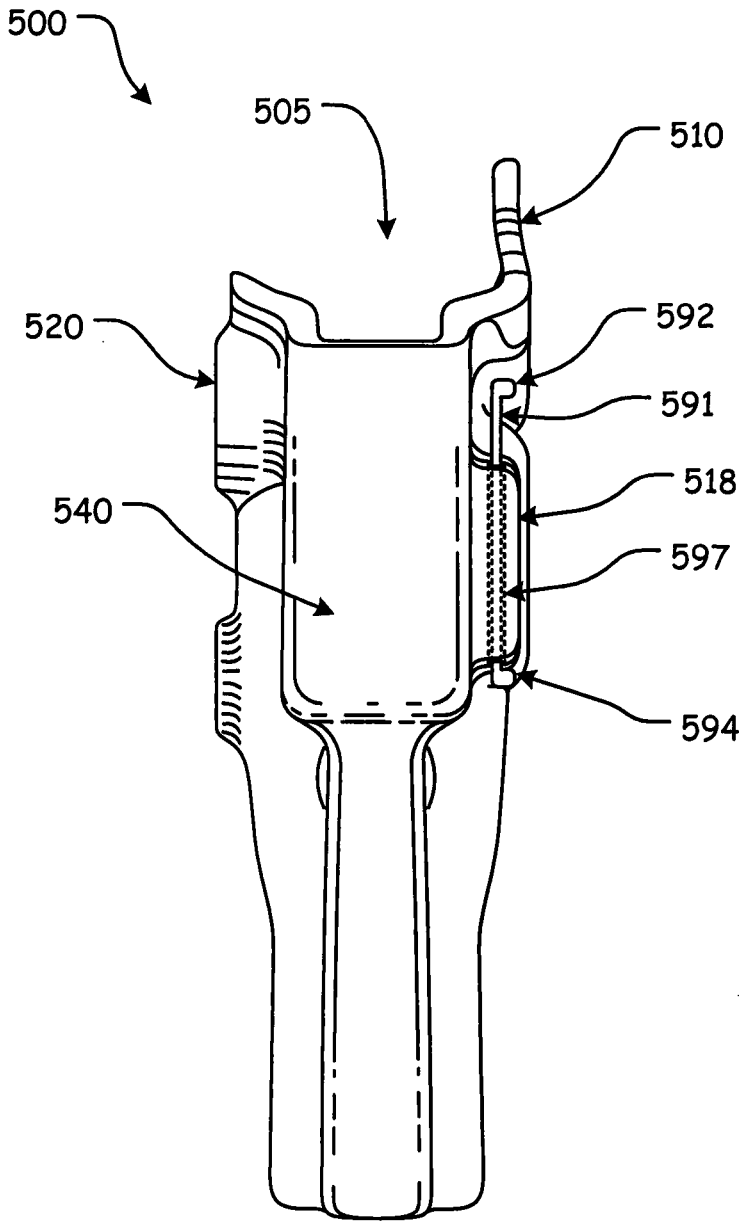
FIG. 17 shows a rear elevation view of an exemplary handgun holster having a retention system and a locking slider, showing a locking slider in a locked position according to this invention.

FIGS. 15A and 15B show a right side view and FIG. 17 shows a rear view of an exemplary embodiment of a handgun holster 500 having a retention system according to this invention. FIG. 16A shows a more detailed, cross-sectional view of the retention system of the retention system of the handgun holster 500, showing the locking slider 591 in a locked position, while FIG. 16B shows a more detailed, cross-sectional view of the retention system of the retention system of the handgun holster 500, showing the locking slider 591 in an unlocked position.

As shown in FIGS. 15A-17, the handgun holster 500 includes an open top end 501 and a bottom end 502. The handgun holster 500 further includes a body 503 defining a cavity 505 (having a trigger guard portion 507 and a frame/slide portion 509) for receiving and holding the handgun.

The body 503 comprises a pair of opposed side walls comprising a first side wall 510, a trough 512, an aperture 516, a recess 517, an optional ridge 518 and/or ridge segments 518 and/or 519, a second side wall 520 (not shown), a front wall 530, and a rear wall 540. The handgun holster 500 further comprises attachment points 570 (not shown), optional slots 584 and 582 (not shown), a passive retention screw 586, optionally the biasing element 590 (not shown), and a retention means comprising a lever 550 having a finger button portion 551 and an engagement portion 555. The lever 550 is pivotally connected, via a pivot pin 560, to the first side wall 510.

It should be understood that each of these elements of the holster 500 shown in FIGS. 15A-17 correspond to and operate similarly to the elements of holsters 100-400, as described above with reference to FIGS. 1-14.

However, as shown in FIGS. 15A-17, a slot 597 is formed through a portion of the ridge 518 such that a body portion 596 of a locking slider 591 is capable of being slidably maintained within the slot 597.

The body portion 596 of the locking slider 591 extends from a finger engaging portion 592 to a slide stop portion 594 and includes a notch 598 form and in a proportion of the locking slider body portion 596. When slidably positioned within the slot 597, the locking slider 591 is able to slide between a locked position (as illustrated in FIGS. 15A and 16A) and an unlocked position (as illustrated in FIGS. 15B and 16B). The finger engaging portion 592 and the slide stop portion 594 engage portions of the reached 518 so as to maintain the locking slider 591 within the slot 597.

The notch 598 is shaped so as to allow the engagement portion 555 of the lever 550 to pass therethrough when the locking slider 591 is in the unlocked position and the notch 598 is aligned with the impeachment end 555 (as illustrated in FIGS. 15B and 16B). However, when the locking slider 591 is in the locked position, the body portion 596 is positioned so as to engage the engagement portion 555 of the lever 550 if an attempt is made to pivot the lever 550 from the engaged to the disengaged position and keep the lever 550 from pivoting to the disengaged position (as illustrated in FIGS. 15A and 16A).

In certain exemplary embodiments, the locking slider 591 may freely slide between the locked position and the unlocked position. Alternatively, the locking slider 591 may be naturally maintained either the locked or the unlocked position within the slot 597 unless a force is applied, i.e., by a user's finger, to slide the locking slider 591 to the locked or unlocked position. In various exemplary embodiments, frictional engagement between the surfaces of the slot 597 and the locking slider 591 work to maintain the locking slider and a desired position. In other exemplary embodiments, one or more mating protrusions and/or detents or other means may be provided to maintain the locking slider and the locked or unlocked position.

In order for a user to depresses the finger button portion 551 of the lever 550 of the holster 500 a sufficient distance to pivot the lever 550 to the disengaged position, the locking slider 591 must be in the unlocked position (as illustrated in FIGS. 15A and 16A). If the locking slider 591 is in the locked position (as illustrated in FIGS. 15B and 16B), the body portion 596 is positioned so as to engage the engagement portion 555 of the lever 550 and keep the lever 550 from being pivoted to the disengaged position.

In various exemplary embodiments, the locking slider 591 may include one or more lockout apertures 593 and/or 595. If included, the lockout apertures 593 and/or 595 allow a lock or other device to be positioned within a portion of the body portion 596 to maintain the locking slider 591 in the locked or unlocked position.

FIG. 17 shows handgun holster having a retention system and a locking slider 591, wherein the locking slider 591 is in a locked position according to this invention.

Figure 18A:
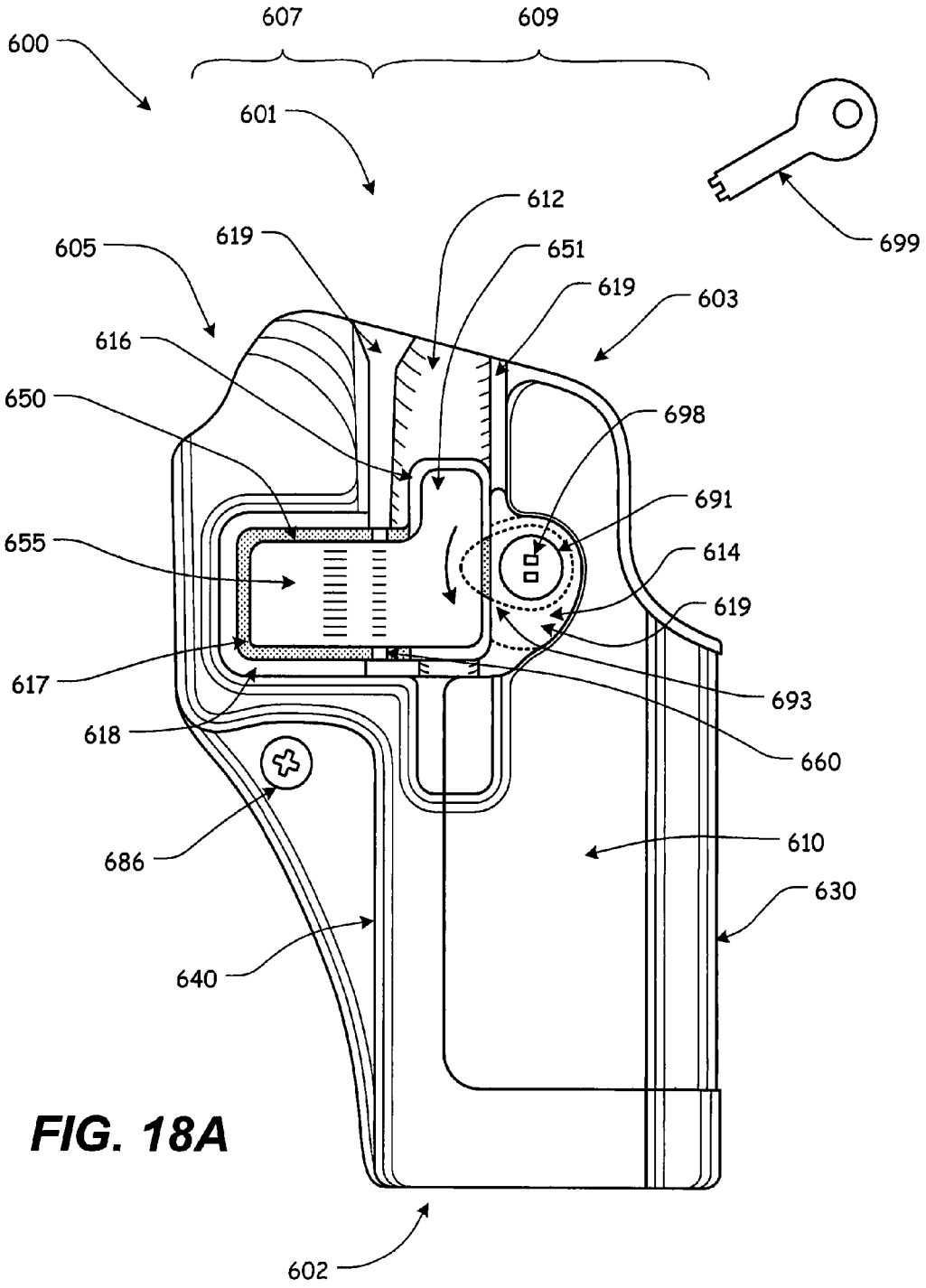
FIG. 18A shows an exemplary embodiment of a handgun holster having a retention system that includes a lockout lever, wherein the lockout lever is in a locked position according to this invention.
Figure 18B:
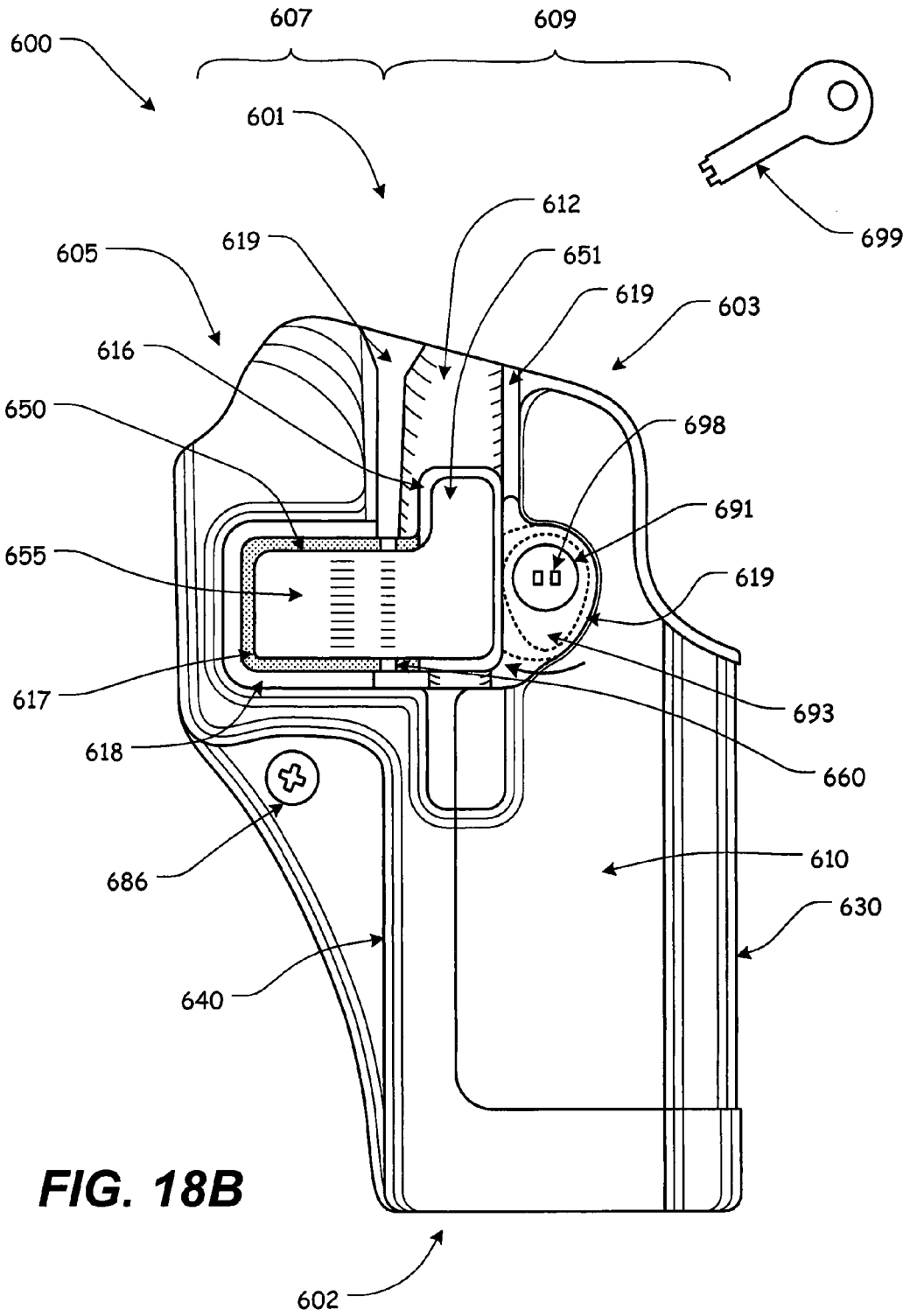
FIG. 18B shows an exemplary embodiment of a handgun holster having a retention system that includes a lockout lever, wherein the lockout lever is in an unlocked position according to this invention.

FIGS. 18A and 18B show an exemplary embodiment of a handgun holster 600 having a retention system according to this invention. FIG. 18A shows the lockout lever 691 in a locked position, while FIG. 18B shows the lockout lever 691 in an unlocked position.

As shown in FIGS. 18A and 18B, the handgun holster 600 includes an open top end 601 and a bottom end 602. The handgun holster 600 further includes a body 603 defining a cavity 605 (having a trigger guard portion 607 and a frame/slide portion 609) for receiving and holding the handgun.

The body 603 comprises a pair of opposed side walls comprising a first side wall 610, a trough 612, an aperture 616, a recess 617, an optional ridge 618 and/or ridge segments 618 and/or 619, a second side wall 620 (not shown), a front wall 630, and a rear wall 640. The handgun holster 600 further comprises attachment points 670 (not shown), optional slots 684 and 682 (not shown), a passive retention screw 686, optionally the biasing element 690 (not shown), and a retention means comprising a lever 650 having a finger button portion 651 and an engagement portion 655. The lever 650 is pivotally connected, via a pivot pin 660, to the first side wall 610.

It should be understood that each of these elements of the holster 600 shown in FIGS. 18A and 18B correspond to and operate similarly to the elements of holsters 100-300, as described above with reference to FIGS. 1-11B.

However, as shown in FIGS. 18A and 18B, a surface hollow or concavity 614 is formed within a portion of the ridge segment 619 of the side wall 610 such that a lockout lever 691 is rotatably attached within a portion of the hollow 614. The hollow 614 is formed such that a locking portion 693 of a lockout lever 691 is capable of being rotatably maintained within the hollow 614.

In various exemplary embodiments, the lockout lever 691 includes at least one key slot 698 that is capable of interacting with one or more mating portions of a key 699, such that rotation of the lockout lever 691 can be accomplished by interaction of the one or more mating portions of the key 699 and the at least one key slot 698. Thus, through the interaction of a key 699 and key slots 698 of the lockout lever 691, the lockout lever 691 can be rotated between a locked position (as illustrated in FIG. 18A) and an unlocked position (as illustrated in FIG. 18B).

Alternatively, the lockout lever 691 may include certain surface features of preparations that allow the lockout lever 691 to be rotated between the locked position and the unlocked position without use of the key 699.

The lockout lever 691 includes a locking portion 693 that, when the lockout lever 691 is in the locked position (as illustrated in FIG. 18A), extends below the finger button portion 651 of the release lever 650 to block the finger button portion 651 of the release lever 650 and keep the release lever 650 from being pivoted to the disengaged position, if an attempt is made to pivot the release lever 650 from the engaged to the disengaged position.

When the lockout lever 691 is in the unlocked position (as illustrated in FIG. 18B), the locking portion of the lockout lever 691 is withdrawn from beneath the finger button portion 651 of the release lever 650 so as to allow the finger button portion 651 of the release lever 650 to be pivoted to the disengaged position.

In certain exemplary embodiments, the lockout lever 691 is freely rotatable between the locked position and the unlocked position. Alternatively, the lockout lever 691 may be frictionally maintained, by, for example, frictional engagement between the holster body 603 and the lockout lever 691, in either the locked or the unlocked position unless a sufficient force is applied, i.e., by the key 699, to rotate the lockout lever 691 to the locked or unlocked position.

In order for a user to depresses the finger button portion 651 of the release lever 650 a sufficient distance to pivot the release lever 650 to the disengaged position, the lockout lever 691 must be in the unlocked position (as illustrated in FIG. 18B). If the lockout lever 691 is in the locked position (as illustrated in FIG. 18A), the locking portion 693 is positioned so as to contact a bottom surface of the finger button portion 651 and block the finger button portion 651 of the release lever 650 and keep the release lever 650 from being pivoted to the disengaged position.

Figure 19:
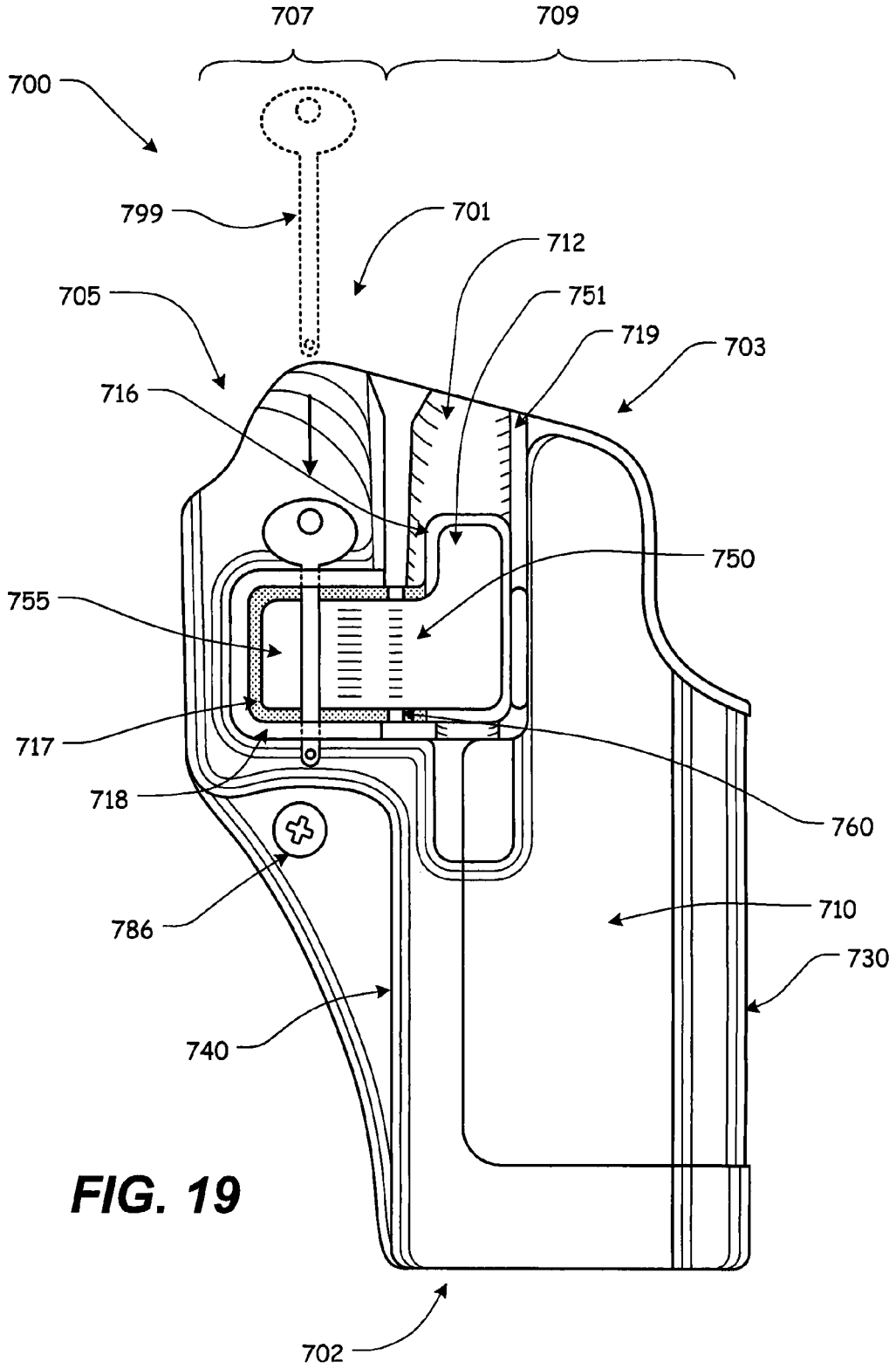
FIG. 19 shows an exemplary embodiment of a handgun holster having a retention system with a lockout key in a retention system lockout position.

FIG. 19 shows an exemplary embodiment of a handgun holster 700 having a retention system with a lockout key 799 in a retention system lockout position.

As shown in FIG. 19, the handgun holster 700 includes an open top end 701 and a bottom end 702. The handgun holster 700 further includes a body 703 defining a cavity 705 (having a trigger guard portion 707 and a frame/slide portion 709) for receiving and holding the handgun.

The body 703 comprises a pair of opposed side walls comprising a first side wall 710, a trough 712, an aperture 716, a recess 717, an optional ridge 718 and/or ridge segments 718 and/or 719, a second side wall 720 (not shown), a front wall 730, and a rear wall 740. The handgun holster 700 further comprises attachment points 770 (not shown), optional slots 784 and 782 (not shown), a passive retention screw 786, optionally the biasing element 790 (not shown), and a retention means comprising a lever 750 having a finger button portion 751 and an engagement portion 755. The lever 750 is pivotally connected, via a pivot pin 760, to the first side wall 710.

It should be understood that each of these elements of the holster 700 shown in FIG. 19 correspond to and operate similarly to the elements of holsters 100-300, as described above with reference to FIGS. 1-11B.

However, as shown in FIG. 19, two aligned apertures are formed within a portion of the ridge 718 such that a lockout key 799 may be positioned within the aligned apertures.

When the lockout key 799 is in the retention system lockout position (as illustrated in FIG. 19), a portion of the body of the lockout key 799 extends, between the aligned apertures, above the engagement portion 755 of the release lever 750 to block the engagement portion 755 of the release lever 750 and keep the release lever 750 from being pivoted to the disengaged position, if an attempt is made to pivot the release lever 750 from the engaged to the disengaged position.

Figure 20:
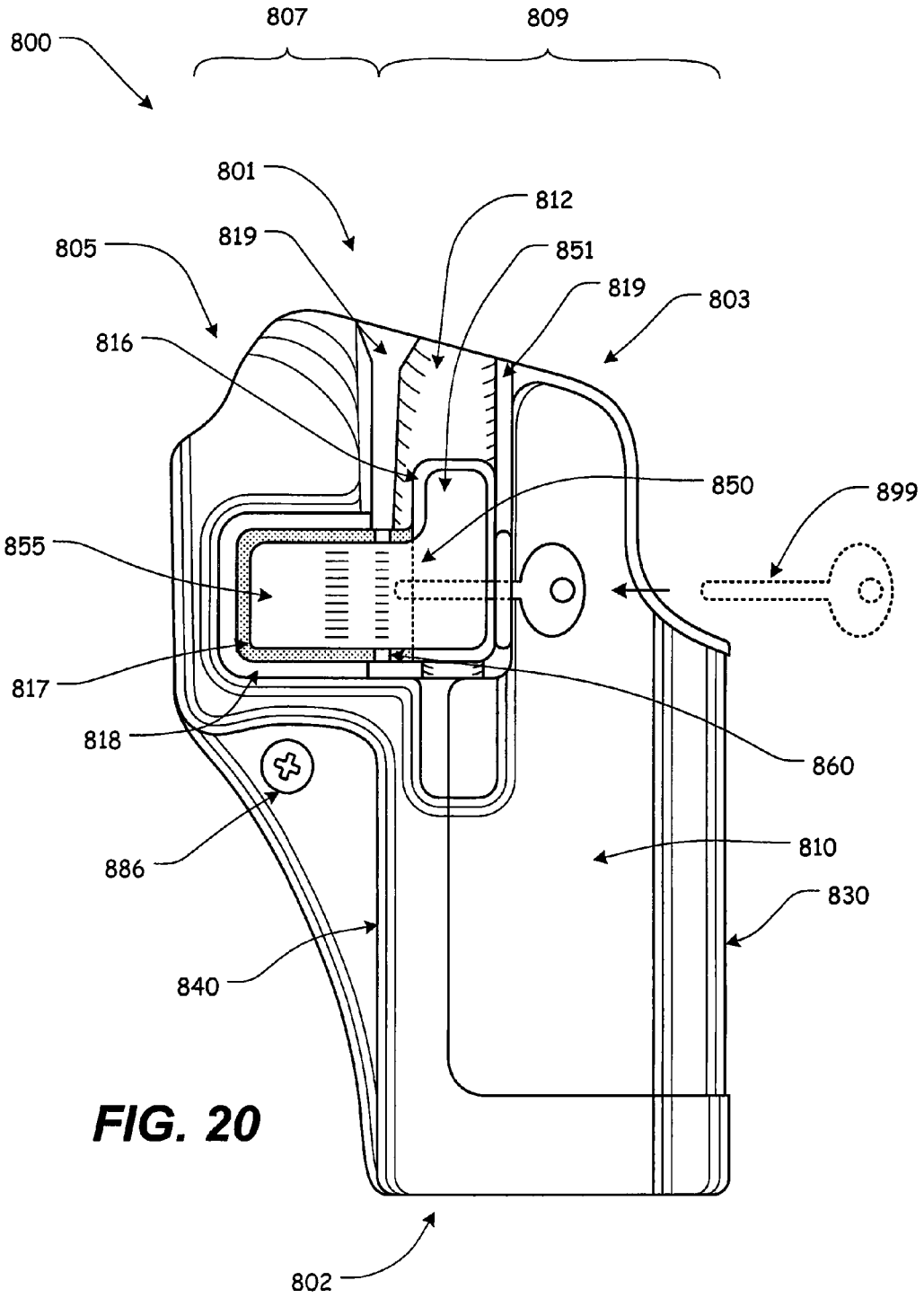
FIG. 20 shows an exemplary embodiment of a handgun holster having a retention system with a lockout key in a retention system lockout position.

FIG. 20 shows an exemplary embodiment of a handgun holster 800 having a retention system with a lockout key 899 in a retention system lockout position.

As shown in FIG. 20, the handgun holster 800 includes an open top end 801 and a bottom end 802. The handgun holster 800 further includes a body 803 defining a cavity 805 (having a trigger guard portion 807 and a frame/slide portion 809) for receiving and holding the handgun.

The body 803 comprises a pair of opposed side walls comprising a first side wall 810, a trough 812, an aperture 816, a recess 817, an optional ridge 818 and/or ridge segments 818 and/or 819, a second side wall 820 (not shown), a front wall 830, and a rear wall 840. The handgun holster 800 further comprises attachment points 870 (not shown), optional slots 884 and 882 (not shown), a passive retention screw 886, optionally the biasing element 890 (not shown), and a retention means comprising a lever 850 having a finger button portion 851 and an engagement portion 855. The lever 850 is pivotally connected, via a pivot pin 860, to the first side wall 810.

It should be understood that each of these elements of the holster 800 shown in FIG. 20 correspond to and operate similarly to the elements of holsters 100-300, as described above with reference to FIGS. 1-11B.

However, as shown in FIG. 20, an aperture is formed within a portion of the ridge segment 819 such that a lockout key 899 may be positioned within the aperture.

When the lockout key 899 is in the retention system lockout position (as illustrated in FIG. 20), a portion of the body of the lockout key 899 extends, between the aperture and the body 803, below the finger button portion 851 of the release lever 850 to block the finger button portion 851 of the release lever 850 and keep the release lever 850 from being pivoted to the disengaged position, if an attempt is made to pivot the release lever 850 from the engaged to the disengaged position.

Figure 21:
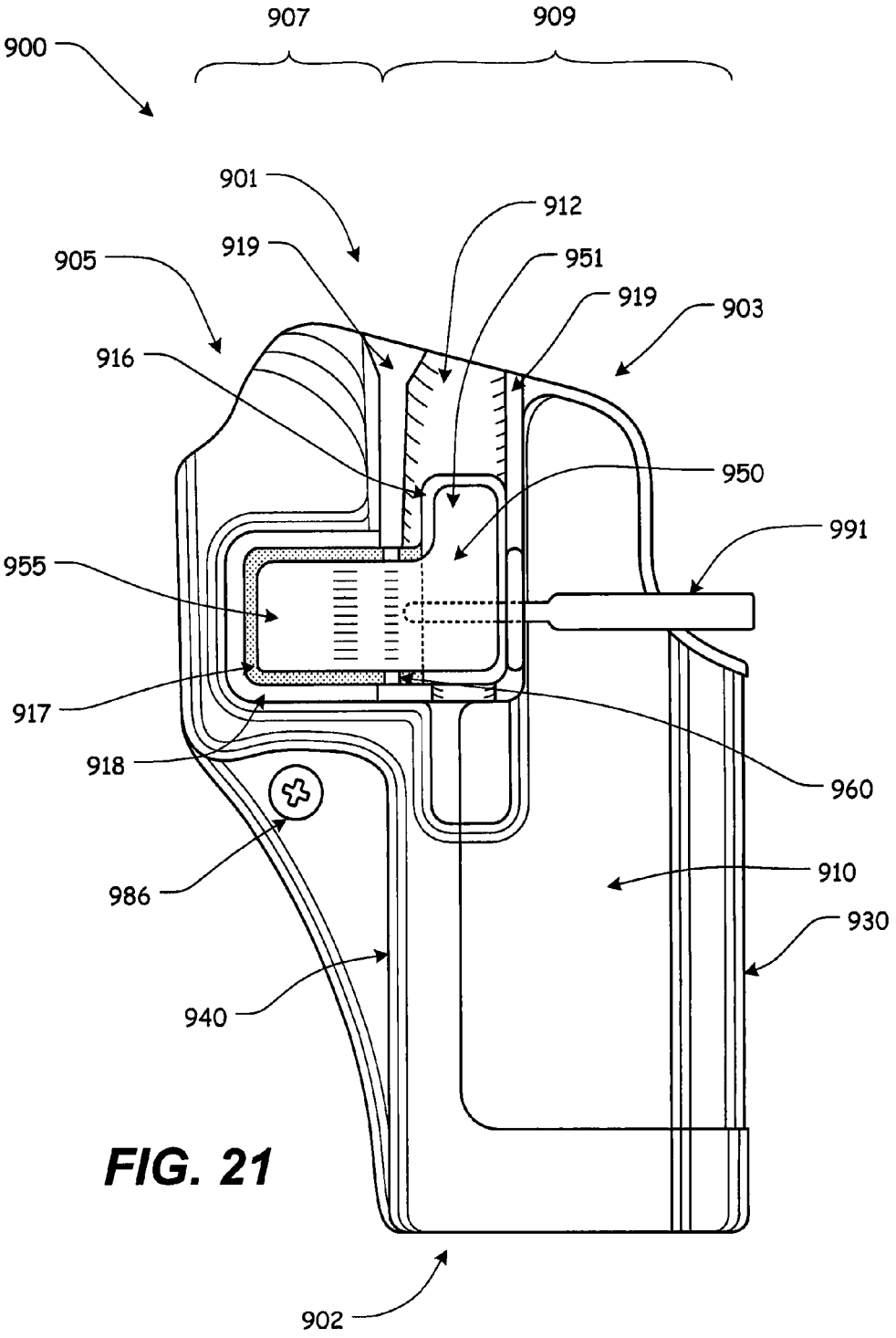
FIG. 21 shows a side view of an exemplary embodiment of a handgun holster having a retention system with a lockout band in a retention system lockout position.
Figure 22:
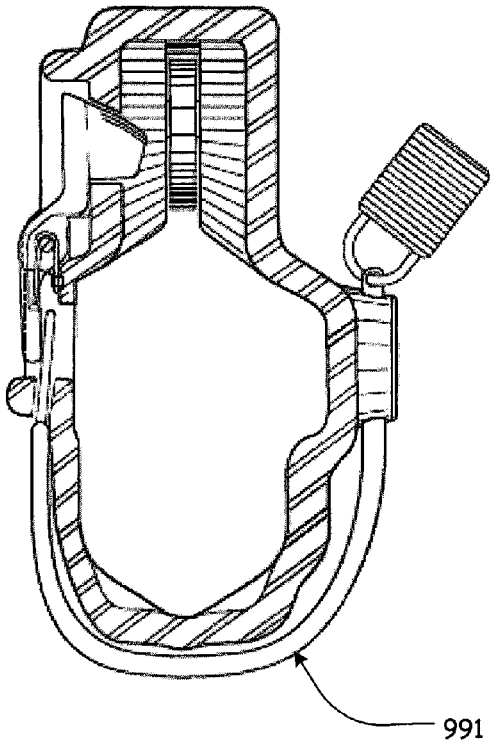
FIG. 22 shows a top, cut-away view of an exemplary embodiment of a handgun holster having a retention system with a lockout band in a retention system lockout position.
Figure 23:
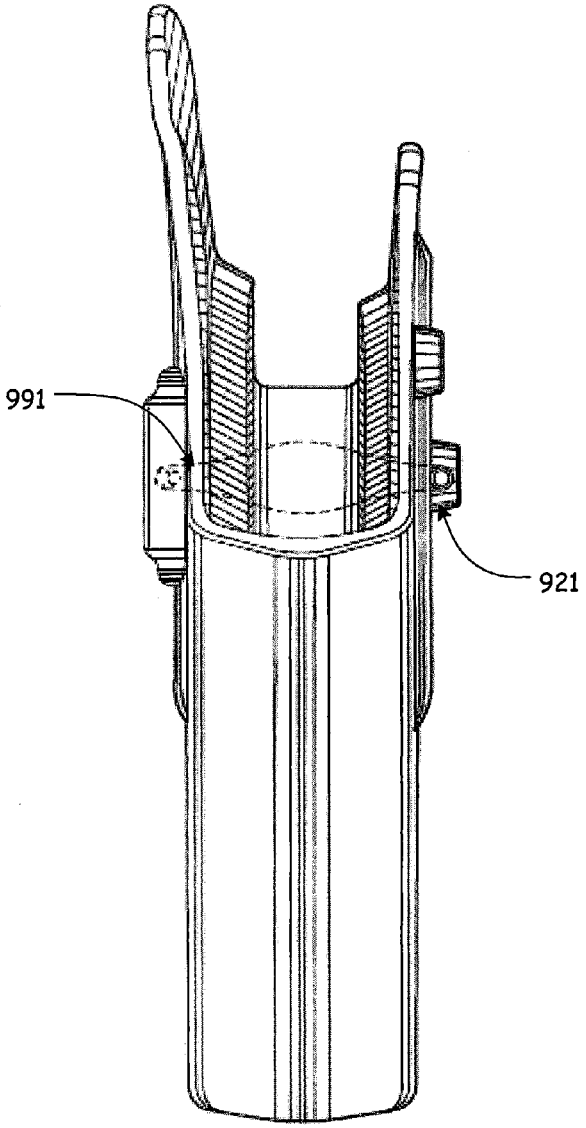
FIG. 23 shows a front view of an exemplary embodiment of a handgun holster having a retention system with a lockout band in a retention system lockout position.

FIGS. 21-23 show an exemplary embodiment of a handgun holster 900 having a retention system with a lockout band 991 in a retention system lockout position.

As shown in FIGS. 21-23, the handgun holster 900 includes an open top end 901 and a bottom end 902. The handgun holster 900 further includes a body 903 defining a cavity 905 (having a trigger guard portion 907 and a frame/slide portion 909) for receiving and holding the handgun.

The body 903 comprises a pair of opposed side walls comprising a first side wall 910, a trough 912, an aperture 916, a recess 917, an optional ridge 918 and/or ridge segments 918 and/or 919, a second side wall 920 (not shown), a front wall 930, and a rear wall 940. The handgun holster 900 further comprises attachment points 970 (not shown), optional slots 984 and 982 (not shown), a passive retention screw 986, optionally the biasing element 990 (not shown), and a retention means comprising a lever 950 having a finger button portion 951 and an engagement portion 955. The lever 950 is pivotally connected, via a pivot pin 960, to the first side wall 910.

It should be understood that each of these elements of the holster 900 shown in FIGS. 21-23 correspond to and operate similarly to the elements of holsters 100-300, as described above with reference to FIGS. 1-11B.

However, as shown in FIGS. 21-23, an aperture is formed within a portion of the ridge segment 919 such that a lockout band 991 may be positioned within the aperture. A similar aperture is formed within the portion of a ridge segment 921 such that a portion of the lockout band 991 may be positioned within the aperture. When portions of the lockout band 991 are positioned within the apertures, the lockout band 991 is in the retention system lockout position.

When the lockout band 991 is in the retention system lockout position (as illustrated in FIGS. 21-23), a portion of the body of the lockout band 991 extends, between the aperture and the body 903, below the finger button portion 951 of the release lever 950 to block the finger button portion 951 of the release lever 950 and keep the release lever 950 from being pivoted to the disengaged position, if an attempt is made to pivot the release lever 950 from the engaged to the disengaged position.

Figure 24A:
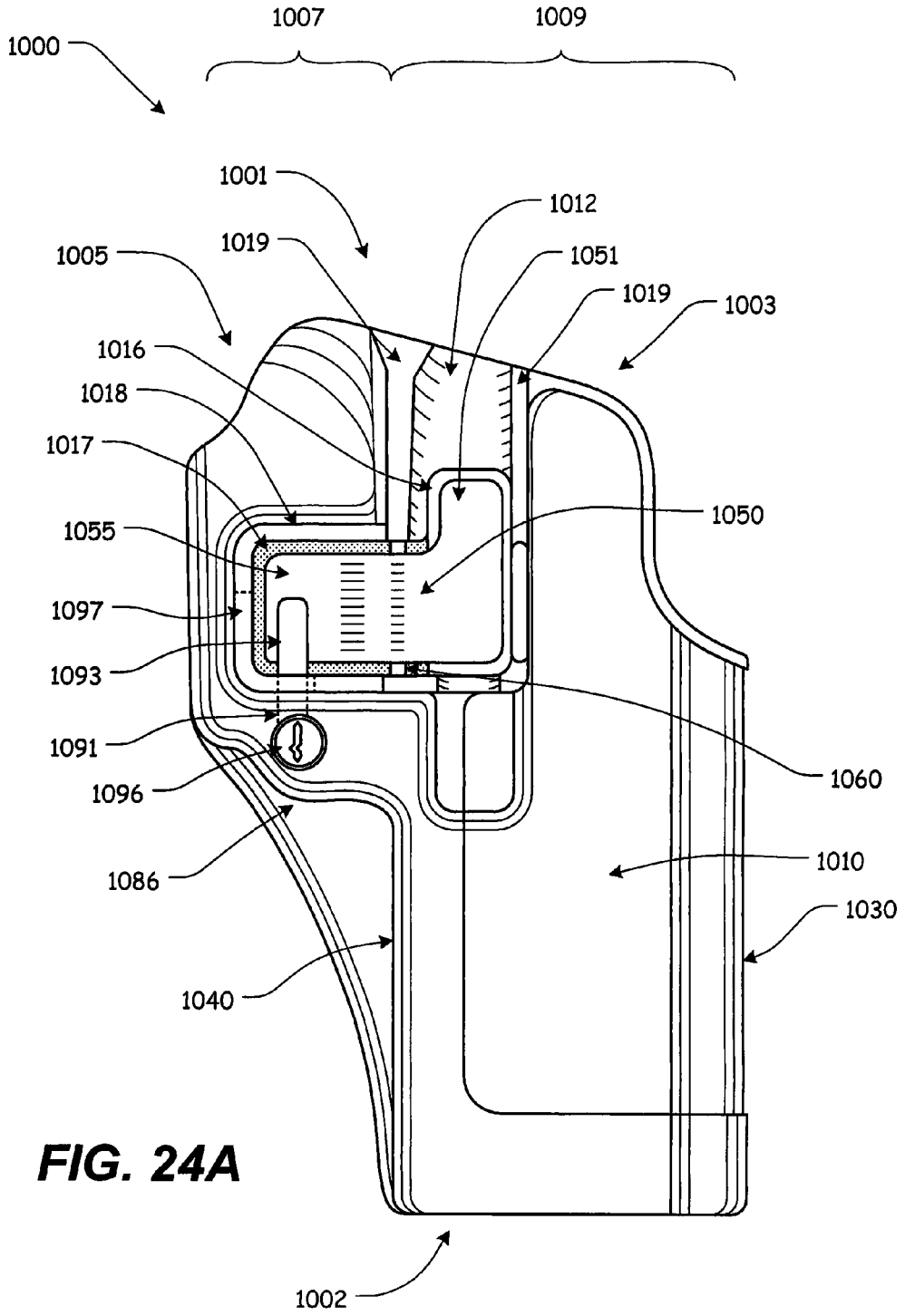
FIG. 24A shows an exemplary embodiment of a handgun holster having a retention system that includes a keyed lockout lever, wherein the keyed lockout lever is in a locked position according to this invention.
Figure 24B:
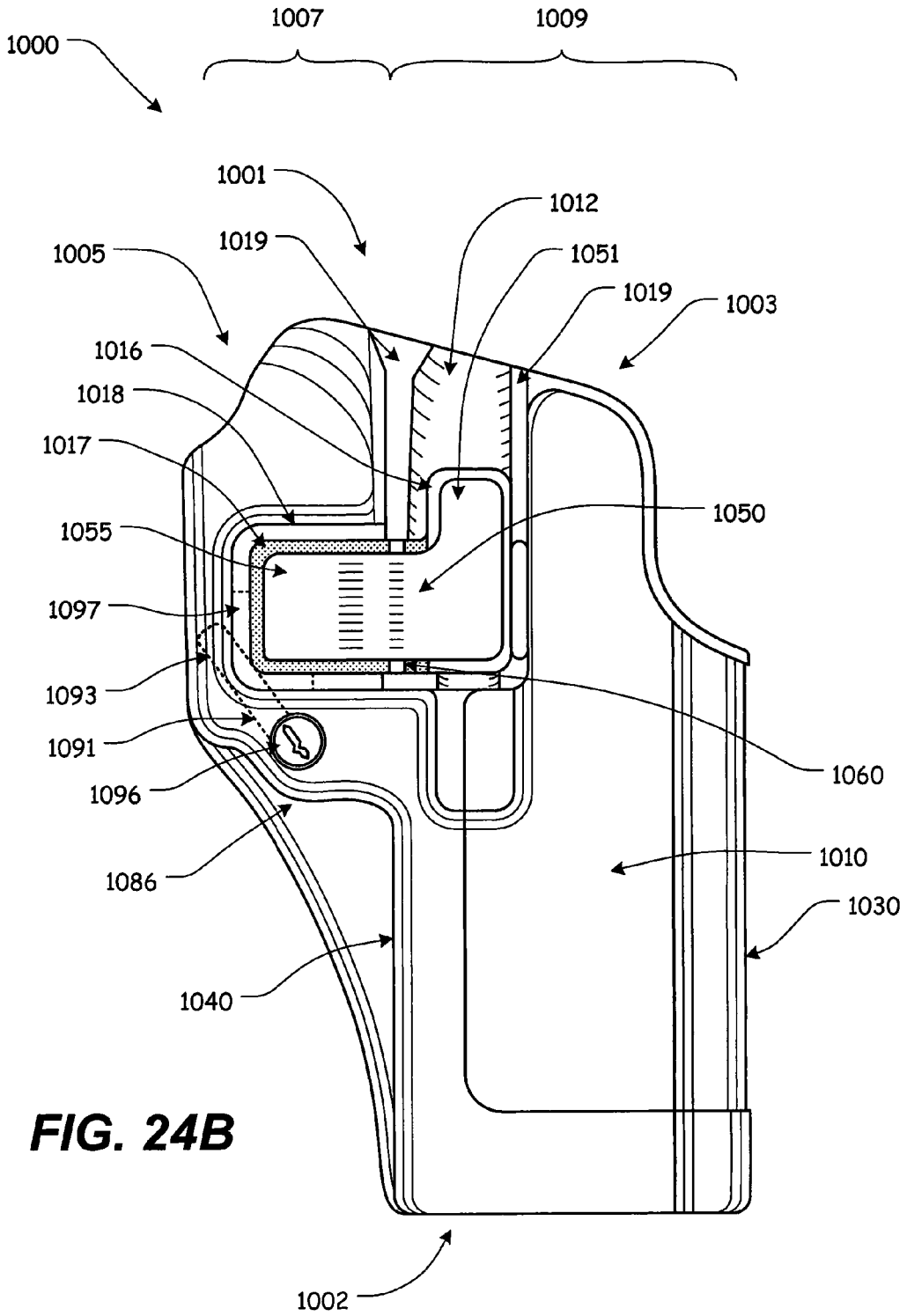
FIG. 24B shows an exemplary embodiment of a handgun holster having a retention system that includes a keyed lockout lever, wherein the keyed lockout lever is in an unlocked position according to this invention.

FIGS. 24A and 24B show an exemplary embodiment of a handgun holster 1000 having a retention system according to this invention. FIG. 24A shows a keyed lockout lever 1091 in a locked position, while FIG. 24B shows the keyed lockout lever 1091 in an unlocked position.

As shown in FIGS. 24A and 24B, the handgun holster 1000 includes an open top end 1001 and a bottom end 1002. The handgun holster 1000 further includes a body 1003 defining a cavity 1005 (having a trigger guard portion 1007 and a frame/slide portion 1009) for receiving and holding the handgun.

The body 1003 comprises a pair of opposed side walls comprising a first side wall 1010, a trough 1012, an aperture 1016, a recess 1017, an optional ridge 1018 and/or ridge segments 1018 and/or 1019, a second side wall 1020 (not shown), a front wall 1030, and a rear wall 1040. The handgun holster 1000 further comprises attachment points 1070 (not shown), optional slots 1084 and 1082 (not shown), a passive retention screw 1086, optionally the biasing element 1090 (not shown), and a retention means comprising a lever 1050 having a finger button portion 1051 and an engagement portion 1055. The lever 1050 is pivotally connected, via a pivot pin 1060, to the first side wall 1010.

It should be understood that each of these elements of the holster 1000 shown in FIGS. 24A and 24B correspond to and operate similarly to the elements of holsters 100-300, as described above with reference to FIGS. 1-11B.

However, as shown in FIGS. 24A and 24B, a cavity is formed within a portion of the ridge 1018 such that a keyed lockout lever 1091 is pivotably attached within a portion of the side wall 1010. The cavity is formed such that a locking portion 1093 of a keyed lockout lever 1091 is capable of being maintained within the cavity.

A slot 1097 is formed through a portion of the ridge 1018 such that a body portion 1096 of the keyed lockout lever 1091 is capable of being slidably maintained within the slot 1097. Through the interaction of a key and the body portion 1096 of the keyed lockout lever 1091, the keyed lockout lever 1091 is able to be rotated between a locked position (as illustrated in FIG. 24A) and an unlocked position (as illustrated in FIG. 24B).

The keyed lockout lever 1091 includes a locking portion 1093 that, when the keyed lockout lever 1091 is in the locked position (as illustrated in FIG. 24A), extends above the engagement portion 1055 of the release lever 1050 to block the engagement portion 1055 of the release lever 1050 and keep the release lever 1050 from being pivoted to the disengaged position, if an attempt is made to pivot the release lever 1050 from the engaged to the disengaged position.

When the keyed lockout lever 1091 is in the unlocked position (as illustrated in FIG. 24B), the locking portion 1093 of the keyed lockout lever 1091 is withdrawn from above the engagement portion 1055 of the release lever 1050 so as to allow the engagement portion 1055 of the release lever 1050 to be pivoted to the disengaged position.

In order for a user to depresses the finger button portion 1051 of the release lever 1050 a sufficient distance to pivot the release lever 1050 to the disengaged position, the keyed lockout lever 1091 must be in the unlocked position (as illustrated in FIG. 24B). If the keyed lockout lever 1091 is in the locked position (as illustrated in FIG. 24A), the locking portion 1093 is positioned so as to contact a top surface of the engagement portion 1055 and block the engagement portion 1055 of the release lever 1050 and keep the release lever 1050 from being pivoted to the disengaged position.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A holster for a handgun, comprising:

a cavity;

a lever having a finger button portion and an engagement portion, wherein said lever includes a locking projection extending from at least a portion of said engagement portion, and wherein said lever is pivotally attached or coupled to at least a portion of said holster, approximately between said finger button portion and said engagement portion; and a lockout lever rotatably attached or coupled to at least a portion of said holster such that said lockout lever is rotatable between a locked position and an unlocked position, and wherein at least a portion of a locking portion of said lockout lever is positioned beneath at least a portion of said finger button portion of said lever when said lockout lever is in said locked position.

2. The holster of claim 1, wherein said cavity comprises a frame/slide portion and a trigger guard portion, wherein said frame/slide portion of said cavity has greater depth than said trigger guard portion of said cavity.

3. The holster of claim 1, wherein said cavity comprises a frame/slide portion and a trigger guard portion, wherein said frame/slide portion is contoured to accept at least a portion of a frame/slide of a handgun and said trigger guard portion is contoured to accept at least a portion of a trigger guard of a handgun, and wherein at least a portion of said engagement portion is positioned above at least a portion of said trigger guard portion of said cavity.

4. The holster of claim 1, wherein said lever is pivotally attached to said side wall.

5. The holster of claim 1, further comprising at least one ridge segment extending from said side wall around at least a portion of said lever wherein said lever is pivotally attached to at least a portion of at least one ridge segment.

6. The holster of claim 1, further comprising at least one aperture formed in a portion of said side wall beneath at least a portion of said finger button portion of said lever.

7. The holster of claim 1, further comprising a hollow formed within a portion of said side wall, wherein said lockout lever is rotatably secured within at least a portion of said hollow.

8. The holster of claim 1, wherein said holster is substantially rigid.

9. The holster of claim 1, wherein said lockout lever is frictionally maintained in either said locked or said unlocked position unless a sufficient force is applied to rotate said lockout lever.

10. The holster of claim 1, wherein said lockout lever includes at least one key slot that is capable of interacting with one or more mating portions of a key, such that rotation of said lockout lever can be accomplished by interaction of said one or more mating portions of a key and said at least one key slot.

11. The holster of claim 1, wherein said locking projection includes a ramp surface.

12. The holster of claim 7, wherein said hollow is formed within a portion of said at least one ridge segment of said side wall.

13. The holster of claim 1, wherein when said lever is in said engaged position, said locking projection protrudes into at least a portion of said holster cavity, via an opening in said side wall such that said locking projection extends inside said holster cavity and when said lever is in said disengaged position, said locking projection is at least partially withdrawn from said holster cavity.

14. The holster of claim 1, wherein said lever is pivotable between an engaged position and a disengaged position.

15. The holster of claim 14, wherein said lever is biased to said engaged position.

16. The holster of claim 14, wherein if said lockout lever is in said locked position, at least a portion of said locking portion of said lockout lever extends beneath said finger button portion of said release lever to keep said release lever from pivoting to said disengaged position, and wherein if said lockout lever is in said unlocked position, said locking portion of said lockout lever is withdrawn from beneath said finger button portion of said release lever so as to allow said release lever to be pivoted to said disengaged position.

17. A holster for a handgun, comprising:

a cavity having a frame/slide portion, and a trigger guard portion;

a lever having a finger button portion and an engagement portion, wherein said lever includes a second side facing generally toward said cavity, wherein said engagement portion of said lever includes a locking projection extending from at least a portion of said second side of said engagement portion, wherein said lever is pivotally attached or coupled to at least a portion of said holster, approximately between said finger button portion and said engagement portion, and wherein said lever is pivotable between an engaged position and a disengaged position;

at least one ridge segment extending from at least a portion of a side wall of said holster, around at least a portion of said lever so as to define a recess, wherein at least a portion of said engagement portion of said lever is positioned within at least a portion of said recess; and a lockout lever rotatably attached or coupled to at least a portion of said holster such that said lockout lever is rotatable between a locked position and an unlocked position, and wherein at least a portion of a locking portion of said lockout lever is positioned beneath at least a portion of said finger button portion of said lever when said lockout lever is in said locked position.

18. The holster of claim 17, further comprising a hollow formed within a portion of said side wall, wherein said lockout lever is rotatably secured within at least a portion of said hollow.

19. The holster of claim 17, wherein when said lever is in said engaged position, said locking projection protrudes into said holster cavity, via an opening in said side wall such that said locking projection extends inside said holster cavity and when said lever is in said disengaged position, said locking projection is at least partially withdrawn from said holster cavity.

20. A holster, comprising:

a cavity;

a lever having a finger button portion and an engagement portion, wherein said lever includes a locking projection extending from at least a portion of said engagement portion, wherein said lever is pivotally attached or coupled to at least a portion of said holster, approximately between said finger button portion and said engagement portion, and wherein said lever is pivotable between an engaged position and a disengaged position; and a lockout lever rotatably attached or coupled to at least a portion of said holster such that said lockout lever is rotatable between a locked position and an unlocked position, and wherein at least a portion of a locking portion of said lockout lever limits movement of said lever between said engaged position and said disengaged position when said lockout lever is in said locked position, and wherein at least a portion of said lockout lever is positioned beneath at least a portion of said finger button portion of said lever when said lockout lever is in said locked position.

* * * * *